US009704323B2

(12) United States Patent
Ohtomo

(10) Patent No.: US 9,704,323 B2
(45) Date of Patent: Jul. 11, 2017

(54) COIN DISCRIMINATION APPARATUS

(71) Applicant: Asahi Seiko Kabushiki Kaisha, Tokyo (JP)

(72) Inventor: Hiroshi Ohtomo, Saitama (JP)

(73) Assignee: ASAHI SEIKO KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/875,549

(22) Filed: Oct. 5, 2015

(65) Prior Publication Data

US 2016/0171809 A1 Jun. 16, 2016

(30) Foreign Application Priority Data

Dec. 16, 2014 (JP) ..... 2014-253853

(51) Int. Cl.
*G07D 7/00* (2016.01)
*G07D 5/02* (2006.01)
(Continued)

(52) U.S. Cl.
CPC ..... *G07D 5/02* (2013.01); *G07D 3/128* (2013.01); *G07D 3/14* (2013.01); *G07D 5/08* (2013.01); *G07D 2205/00* (2013.01)

(58) Field of Classification Search
CPC G07D 5/00; G07D 5/005; G07D 5/02; G07D 5/04; G07D 5/06; G07D 5/08;
(Continued)

(56) References Cited

U.S. PATENT DOCUMENTS 3,870,137 A * 3/1975 Fougere ..... G07D 5/02 194/317
4,705,154 A * 11/1987 Masho ..... G07D 5/08 194/318
(Continued)

FOREIGN PATENT DOCUMENTS

CN 101449301 6/2009
JP H11250302 9/1999
(Continued)

OTHER PUBLICATIONS

Extended European Search Report dated Jan. 29, 2016 for Corresponding European Patent Application EP16188760.1 (7 pages).
(Continued)

*Primary Examiner* — Jeffrey Shapiro

(57) ABSTRACT

A coin discrimination apparatus capable of discriminating the denomination and authenticity of coins including bimetallic coins. A first coin detection sensor, located near a guide, obtains a physical characteristic of a peripheral part of a coin moved on a carrying path. A second coin detection sensor, located apart from the guide, obtains a physical characteristic about a central part of the coin. A third coin detection sensor, located on a downstream side of respect to the first sensor, obtains a physical characteristic about the peripheral part of a coin. A fourth coin detection sensor, located downstream of the second sensor and apart from the guide, obtains a physical characteristic about a central part of the coin. An additional physical characteristic about the peripheral part of the coin is obtained by cooperation of the second and third sensors when the coin reaches the third sensor.

4 Claims, 9 Drawing Sheets

(51) Int. Cl.
*G07D 5/08* (2006.01)
*G07D 3/12* (2006.01)
*G07D 3/14* (2006.01)

(58) Field of Classification Search
CPC .. G07D 5/10; G07D 3/12; G07D 3/14; G07D 3/128; G07D 2205/00
USPC ..... 194/302, 303, 317–320, 334–338; 453/6, 453/49, 57, 7, 10–15, 33–35, 56; 235/379
See application file for complete search history.

(56) References Cited

U.S. PATENT DOCUMENTS 5,033,603 A * 7/1991 Kai ..... G07D 5/02 194/334
5,379,876 A * 1/1995 Hutton ..... G07D 5/08 194/319
5,433,310 A * 7/1995 Bell ..... G07D 5/08 194/318
5,452,785 A * 9/1995 Iwamoto ..... G07D 5/02 194/318
5,503,262 A * 4/1996 Baudat ..... G06K 9/52 194/206
5,609,234 A * 3/1997 Walker ..... G07D 5/08 194/210
5,788,047 A * 8/1998 Chung ..... G07D 3/14 194/318
5,871,075 A * 2/1999 Takayama ..... G07D 5/08 194/318
5,896,446 A * 4/1999 Sagady ..... G07F 9/08 379/143
5,949,863 A * 9/1999 Tansky ..... G07F 9/08 379/143
5,988,347 A * 11/1999 Schwab ..... G01D 5/02 194/217
6,079,262 A * 6/2000 Palomeque ..... G07D 5/00 194/317
6,082,518 A * 7/2000 Itako ..... G07D 5/02 194/317
6,125,987 A * 10/2000 Abe ..... G07D 5/00 194/213
6,250,453 B1 * 6/2001 Furuya ..... G07D 5/08 194/317
6,293,385 B1 * 9/2001 Hayashi ..... G07D 5/00 194/317
6,305,523 B1 * 10/2001 House ..... G07D 5/005 194/317
6,311,820 B1 * 11/2001 Hallas Bell ..... G07D 5/08 194/317
6,340,082 B1 * 1/2002 House ..... G07D 5/08 194/317
6,425,471 B1 * 7/2002 Guindulain Vidondo ..... G07D 5/04 194/201
6,520,308 B1 * 2/2003 Martin ..... G07D 3/06 194/317
6,536,578 B1 * 3/2003 Ashley ..... G07D 5/08 194/318
6,539,083 B1 * 3/2003 Churchman ..... G07D 5/08 194/316
6,668,999 B2 * 12/2003 Ohtomo ..... G07D 5/08 194/302
6,722,487 B1 * 4/2004 Bell ..... G07D 5/08 194/302
6,830,143 B2 * 12/2004 King ..... G07D 5/00 194/302
7,426,987 B2 9/2008 Umeda et al.
8,550,227 B1 10/2013 Martin
2003/0136629 A1 * 7/2003 King ..... G07D 5/00 194/302
2003/0209402 A1 * 11/2003 Matubara ..... G07D 5/08 194/335
2003/0217907 A1 * 11/2003 Abe ..... G07D 1/02 194/216
2006/0183418 A1 * 8/2006 Umeda ..... G07D 1/02 453/12
2006/0254877 A1 * 11/2006 Mulvey ..... G07D 5/00 194/302
2006/0278495 A1 * 12/2006 Umeda ..... G07D 3/10 194/303
2007/0087675 A1 * 4/2007 Umeda ..... G07D 3/14 453/3
2007/0251799 A1 * 11/2007 Abe ..... G07D 5/02 194/209
2008/0000751 A1 * 1/2008 Ohtomo ..... G07D 5/02 194/317
2009/0048803 A1 * 2/2009 Zwieg ..... G07D 7/16 702/172
2011/0016965 A1 * 1/2011 Sasaki ..... G07D 5/00 73/163
2012/0138420 A1 * 6/2012 Leibu ..... G07D 5/08 194/338
2012/0238196 A1 * 9/2012 Umeda ..... G07D 9/008 453/10

FOREIGN PATENT DOCUMENTS

JP 4780494 9/2011
JP 2012086075 5/2012

OTHER PUBLICATIONS

Communication Pursuant to Article 94(3) EPC Issued Mar. 31, 2017 for Corresponding European Patent Application No. 15188760.1, (4 pages).

* cited by examiner

COIN DISCRIMINATION APPARATUS

BACKGROUND OF THE INVENTION

1. Field of the Invention

The present invention relates to a coin discrimination apparatus and more particularly, to a coin discrimination apparatus that makes it possible to discriminate the denomination and authenticity of coins accurately even if they are bimetallic coins.

The term "coin" used in this specification means widely coins as a currency, tokens, medals, and so on, which may have any shape such as circular and polygonal ones.

2. Description of Related Art

Conventionally, as a prior art, a coin denomination discrimination apparatus is known, as disclosed, for example, in the Japanese Patent No. 4780494 (see FIGS. 2 to 6 and Paragraphs 0026 to 0040). This apparatus comprises a slide base made of a non-magnetic material, a rotator made of a non-magnetic material and formed adjacent to the slide base in such a way as to be rotated in a plane parallel to the slide base, a reference guide formed outside a rotation path of the rotator, and a magnetic sensing device for discriminating the denomination of coins provided near a coin carrying path through which coins are carried by rotation of the rotator.

The magnetic sensing device includes a diameter sensor, a material sensor, and a thickness sensor.

With the prior-art coin denomination discrimination apparatus disclosed in the Japanese Patent No. 4780494, the denomination of target coins is discriminated using one material sensor, one thickness sensor, and three diameter sensors serving as the magnetic sensing device. The material sensor and the thickness sensor are arranged in such a way as to be opposed to not only the central portion of a coin but also the peripheral part thereof.

When discriminating the denomination of a bimetallic coin, where the peripheral part (ring-shaped part) and the central part (i.e., core part) are made of different metals, the data about the materials of the core and ring-shaped parts of the bimetallic coin is obtained by the material sensor and the data about the material of the connection portion of the core and ring-shaped parts thereof is obtained by the same material sensor. Similarly, the data about the thicknesses of the core and ring-shaped parts is obtained by the thickness sensor and the data about the thickness of the connection portion is obtained by the same thickness sensor. Because the connecting portion contains some structural unevenness, the data obtained from the connecting portion is likely to include dispersion or variations. Accordingly, the data obtained from the connecting portion by the material sensor and the data obtained from the connecting portion by the thickness sensor also will include dispersion or variations, which raises a problem of degradation in discrimination accuracy of bimetallic coins.

SUMMARY OF THE INVENTION

The present invention was created to solve the above-mentioned problem of the prior art coin denomination discrimination apparatus, and an object of the present invention is to provide a coin discrimination apparatus capable of discriminating the denomination and authenticity of coins accurately even if they are bimetallic coins.

The above object together with others not specifically mentioned will become clear to those skilled in the art from the following description.

A coin discrimination apparatus according to the present invention comprises:

a base having a carrying path on which coins are carried, wherein one surface of each coin that is moved on the carrying path is supported by the base;

a rotator configured to be rotatable around a rotation axis perpendicular to the base, wherein the rotator has pushing members by which coins are carried on the carrying path one by one due to rotation of the rotator;

a guide formed outside a rotation area of the rotator so as to extend along the carrying path, wherein a coin that is moved on the carrying path is guided by contacting a peripheral face of the coin with the guide; and a coin detector for detecting physical characteristics of a coin that is moved on the carrying path, wherein the coin detector is located along the carrying path;

wherein the coin detector comprises a first coin detection sensor, a second coin detection sensor, a third coin detection sensor, and a fourth coin detection sensor;

the first coin detection sensor, which is located near the guide, has a function of obtaining a physical characteristic about a peripheral part of a coin that is moved on the carrying path;

the second coin detection sensor, which is located apart from the guide at a predetermined interval, has a function of obtaining a physical characteristic about a central part of the coin that is moved on the carrying path;

the third coin detection sensor, which is located on a downstream side of the carrying path at a predetermined interval with respect to the first coin detection sensor and which is located near the guide, has a function of obtaining a physical characteristic about the peripheral part of the coin that is moved on the carrying path;

the fourth coin detection sensor, which is located on the downstream side of the carrying path at a predetermined interval with respect to the second coin detection sensor and which is located apart from the guide at a predetermined interval, has a function of obtaining a physical characteristic about the central part of the coin that is moved on the carrying path; and an additional physical characteristic about the peripheral part of the coin that is moved on the carrying path is obtained by cooperation of the second coin detection sensor and the third coin detection sensor when the coin that is moved on the carrying path reaches the third coin detection sensor.

With the coin discrimination apparatus according to the present invention, as explained above, the base having the carrying path, the rotator for carrying coins on the carrying path one by one, the guide for guiding the coins along the carrying path, and the coin detector for detecting physical characteristics of the coins are provided. The coins that are moved on the carrying path are carried to a predetermined position through the coin detector itself or through the vicinity of the coin detector. The coins that are carried on the carrying path due to the rotation of the rotator are guided by contacting the peripheral face of the coin with the guide.

The coin detector comprises the first to fourth coin detection sensors, which are located at different positions with respect to the guide. This means that the positions of the first to fourth coin detection sensors are respectively determined using the guide as a reference. Moreover, the coin that is moved on the carrying path is guided by contacting the peripheral face of the coin with the guide that extends along the carrying path.

Therefore, the positional relationships between each of the coins that are carried on the carrying path with the first to fourth coin detection sensors are kept approximately the same for all the coins thus carried. Accordingly, the physical characteristics about the peripheral and core parts of the coin that is moved on the carrying path can be detected accurately with the first to fourth coin detection sensors.

Furthermore, the additional physical characteristic about the peripheral part of the coin that is moved on the carrying path is obtained by cooperation of the second and third coin detection sensors when the coin that is moved on the carrying path reaches the third coin detection sensor. This means that the physical characteristics about the different positions of the peripheral part of the coin can be detected by the second and third coin detection sensors approximately simultaneously. For this reason, coin discrimination can be performed using not only the physical characteristics obtained by the first to fourth coin detection sensors but also the additional physical characteristic obtained by the cooperation of the second and third coin detection sensors.

Accordingly, the denomination and authenticity of the coins can be discriminated more accurately compared with the case where the additional physical characteristic is not obtained by the cooperation of the second and third coin detection sensors.

In the case of discriminating a bimetallic coin comprising a ring-shaped part (i.e., a peripheral part) and a core part (i.e., a central part) which are made of different materials or different-composition materials (e.g., different metals and/or alloys), the physical characteristics about the peripheral part of the bimetallic coin are respectively obtained by the first and third coin detection sensors at different positions, and the physical characteristics about the central part of the bimetallic coin are respectively obtained by the second and fourth coin detection sensors at different positions. Moreover, the additional physical characteristic about the peripheral part of the bimetallic coin is obtained by cooperation of the second and third coin detection sensors.

Therefore, even if the connecting portion of the bimetallic coin, which connects the ring-shaped part (peripheral part) and the core part (central part), includes some structural unevenness, the physical characteristics obtained by the first to fourth coin detection sensors and the additional physical characteristic obtained by cooperation of the second and third coin detection sensors are unlikely to be affected by the structural unevenness of the connecting portion.

Accordingly, the denomination and authenticity of coins can be discriminated with high accuracy even if they are bimetallic coins.

In a preferred embodiment of the coin discrimination apparatus according to the present invention, the physical characteristic about the peripheral part of the coin obtained by the first coin detection sensor is a physical characteristic about a thickness of the peripheral part of the coin, the physical characteristic about the central part of the coin obtained by the second coin detection sensor is a physical characteristic about a material of the central part of the coin, the physical characteristic about the peripheral part of the coin obtained by the third coin detection sensor is a physical characteristic about a material of the peripheral part of the coin, the physical characteristic about the central part of the coin obtained by the fourth coin detection sensor is a physical characteristic about a thickness of the central part of the coin, and the additional physical characteristic about the peripheral part of the coin obtained by cooperation of the second and third coin detection sensors is a physical characteristic about the material and a diameter of the peripheral part of the coin.

In this embodiment, since the physical characteristics about the thickness, material, and diameter of the peripheral part of the coin and those about the thickness and material of the central part of thereof are respectively obtained by different coin detection sensors, these characteristics can be detected accurately. Thus, the denomination and authenticity of the coins can be discriminated with high accuracy even if they are bimetallic coins.

In another preferred embodiment of the coin discrimination apparatus according to the present invention, each of the first to fourth coin detection sensors comprises a pair of magnetic material cores and coils wound respectively around the cores.

In this embodiment, magnetic characteristics of the coins are detected by the first to fourth coin detection sensors. Therefore, there is an additional advantage that even if dust or rubbish is attached on the first to fourth coin detection sensors, the denomination and authenticity of the coins can be discriminated with high accuracy without the effect of the dust or rubbish.

In still another preferred embodiment of the coin discrimination apparatus according to the present invention, the coin detector further comprises fifth, sixth, and seventh coin detection sensors. The fifth coin detection sensor is located at a further position from the guide than the second and fourth coin detection sensors. The sixth coin detection sensor is located at a further position from the guide than the fifth coin detection sensor. The seventh coin detection sensor is located on the downstream side of the carrying path with respect to the fifth and sixth coin detection sensors. Each of the fifth to seventh coin detection sensors has a function of obtaining a physical characteristic about a diameter of the coin that is moved on the carrying path.

In this embodiment, the physical characteristic about the diameter of the coin having a relatively small diameter is obtained by the fifth coin detection sensor, the physical characteristic about the diameter of the coin having a relatively large diameter is obtained by the sixth coin detection sensor, and the physical characteristic about the diameter of the coin having a relatively middle diameter is obtained by the seventh coin detection sensor. Thus, compared with the case where the physical characteristic about the diameter of a coin is obtained by a single coin detection sensor, the physical characteristics about the diameter of the coin can be obtained in more detail. As a result, there is an additional advantage that the denomination and authenticity of the coin can be discriminated with higher accuracy than the case where the coin detector does not comprise the fifth, sixth, and seventh coin detection sensors.

In a further preferred embodiment of the coin discrimination apparatus according to the present invention, the coin detector further comprises fifth, sixth, and seventh coin detection sensors. The physical characteristic about a diameter of a coin having a relatively small diameter is obtained by the fifth coin detection sensor, the physical characteristic about a diameter of a coin having a relatively large diameter is obtained by the sixth coin detection sensor, and the physical characteristic about a diameter of a coin having a relatively middle diameter is obtained by the seventh coin detection sensor.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
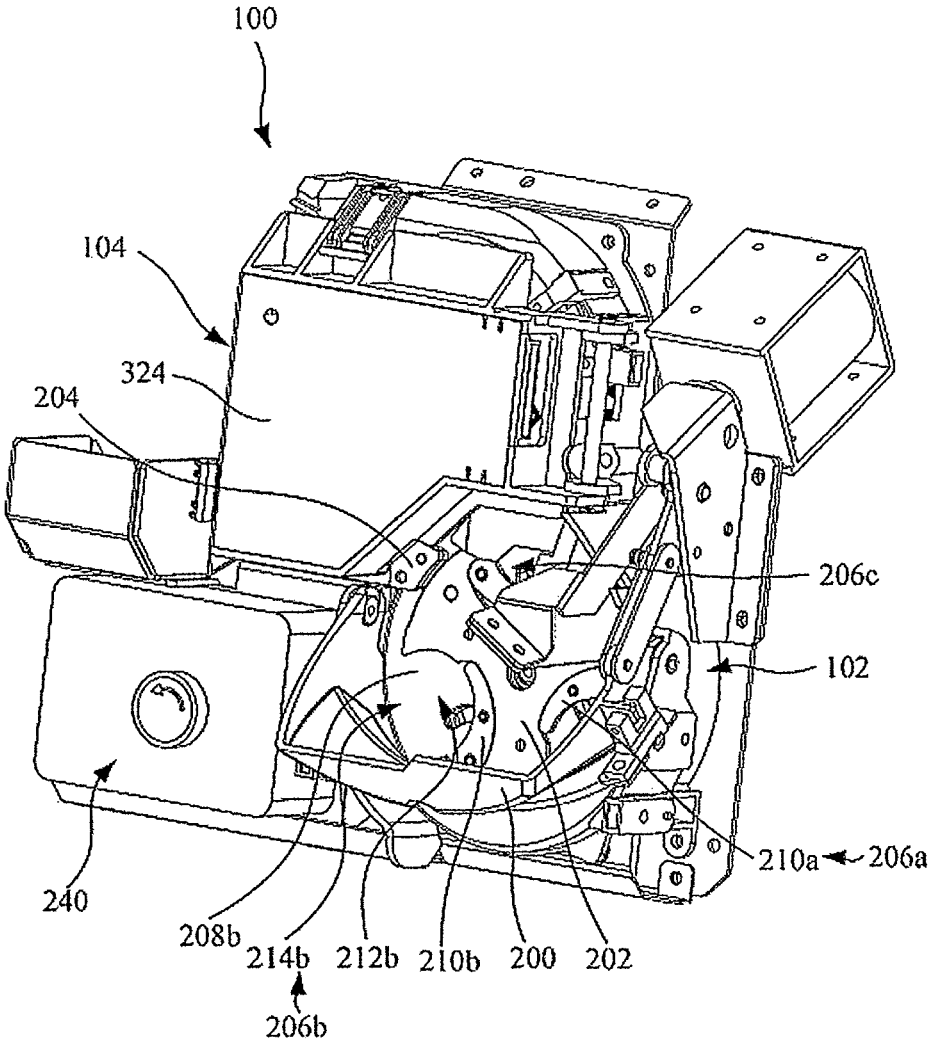
FIG. 1 is a perspective view of a coin discrimination apparatus according to an embodiment of the present invention, which is seen from the front right side of the apparatus.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Preferred embodiments of the present invention will be described in detail below while referring to the Preferred embodiments of the present invention will be described in detail below while referring to the drawings attached.

[Overall Structure of Coin Discrimination Apparatus]

A coin discrimination apparatus 100 according to an embodiment of the present invention is shown in FIGS. 1 to 9.

Figure 2:
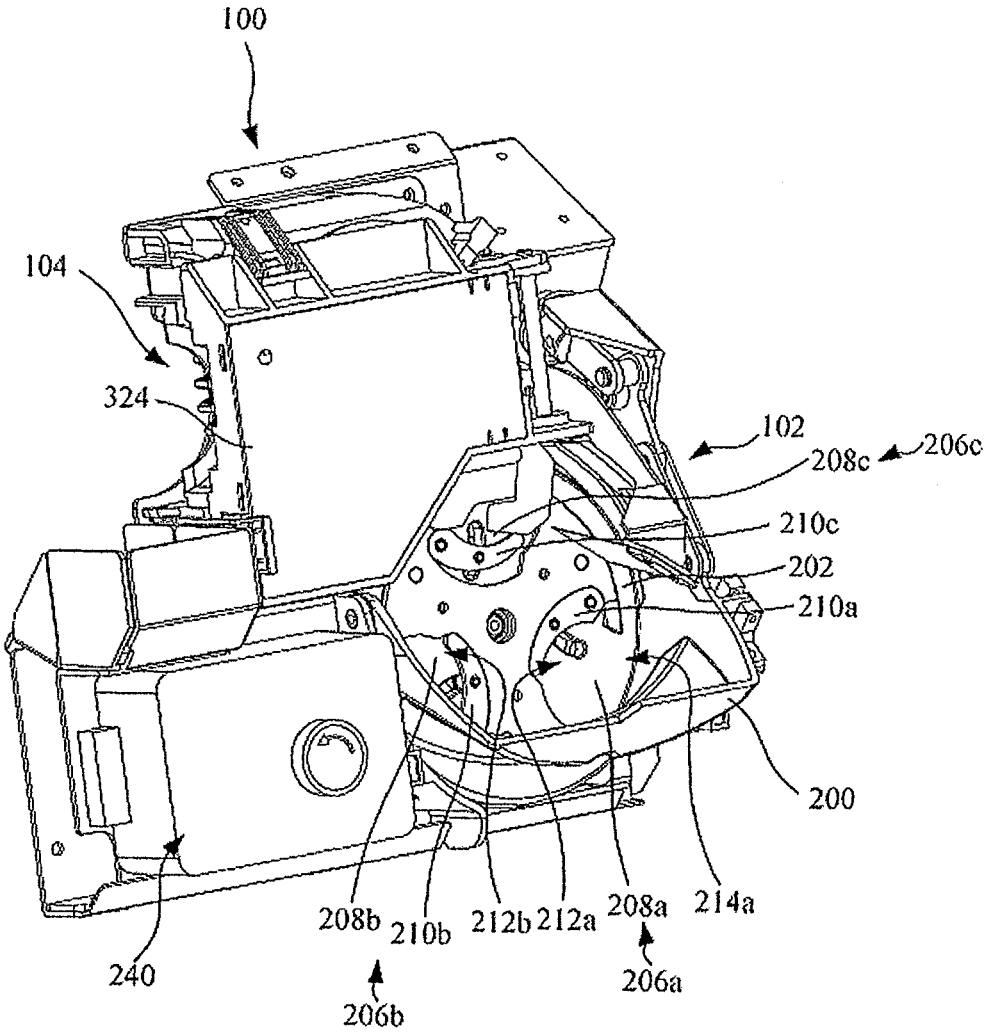
FIG. 2 is a perspective view of the coin discrimination apparatus according to the embodiment of the present invention, which is seen from the front left side of the apparatus.
Figure 3:
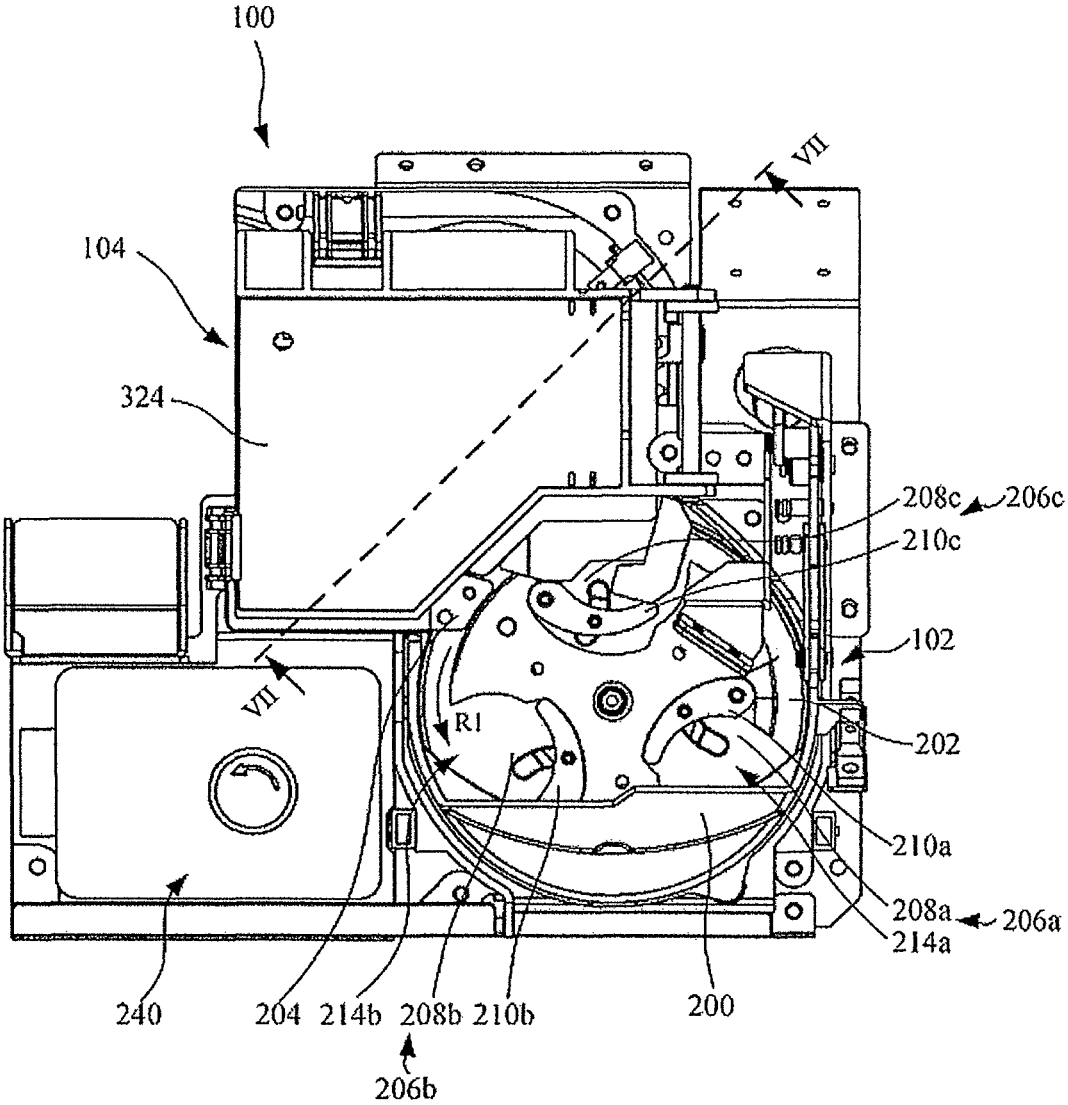
FIG. 3 is a front view of the coin discrimination apparatus according to the embodiment of the present invention.
Figure 4:
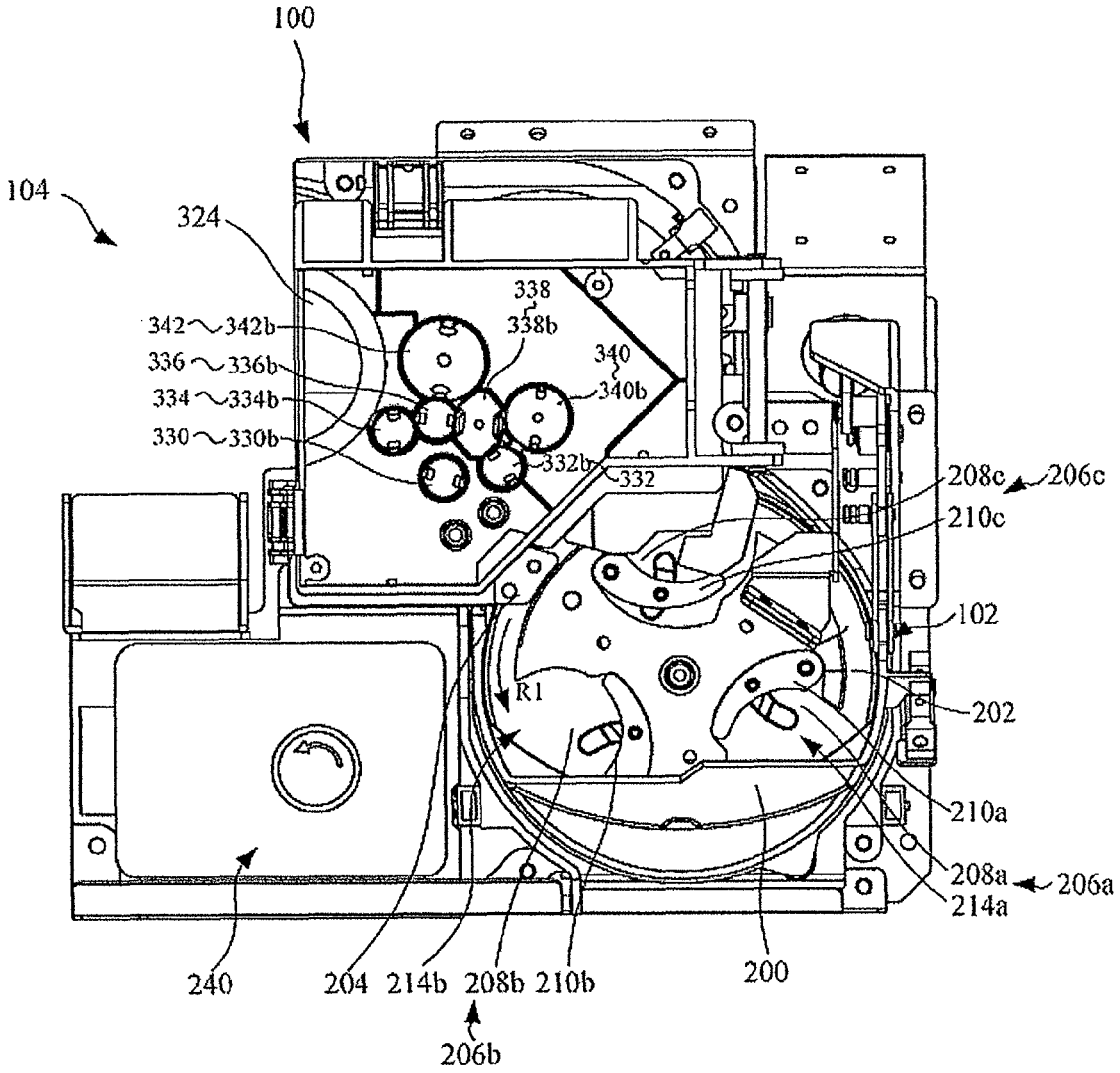
FIG. 4 is a front view of the coin discrimination apparatus according to the embodiment of the present invention, which shows the state where the inside of the upper cover of the apparatus is exposed.
Figure 9:
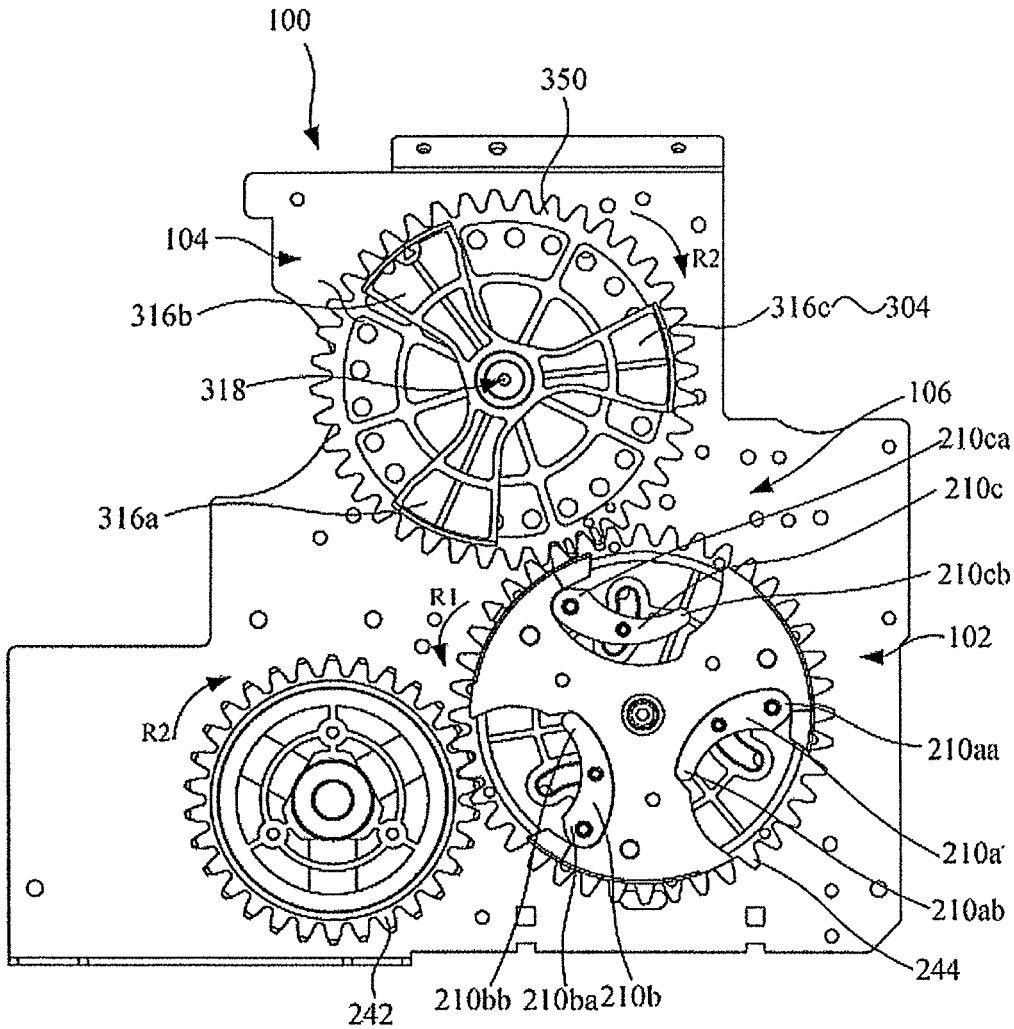
FIG. 9 is a front view of the driving mechanism of the coin discrimination apparatus according to the embodiment of the present invention.

As shown in FIGS. 1, 2 and 9, the coin discrimination apparatus 100 comprises a coin separating and forwarding section 102 for separating coins C that are stacked in bulk from each other and forwarding the coins C thus separated toward the next step, a coin discrimination section 104 for carrying the coins C forwarded from the coin separating and forwarding section 102 toward the next step and discriminating the denomination and authenticity of the coins C, and a driving mechanism 106 for driving a carrying mechanism for the coins C. The coin separating and forwarding section 102 is provided at the lower right position of the apparatus 100. The coin discrimination section 104 is provided at the upper middle position of the apparatus 100. The driving mechanism 106 is provided at the lower left and upper middle positions of the apparatus 100.

The coin separating and forwarding section 102, the coin discrimination section 104, and the driving mechanism 106 of the coin discrimination apparatus 100 may comprises the separated forwarding device disclosed in Japanese Patent No. 4780494 issued in 2011. Since the concrete structure and function of the separated forwarding device are explained in detail in Japanese Patent No. 4780494, the explanation about the structure and function of the separated forwarding device are omitted here.

Applicant hereby incorporates by reference, the subject matter disclosed by the current inventor in U.S. Pat. No. 7,426,987, issued on Sep. 23, 2008 and assigned to the same assignee.

[Coin Separating and Forwarding Section]

Next, the coin separating and forwarding section 102 of the coin discrimination apparatus 100 will be explained below with reference to FIGS. 1 to 5.

The coin separating and forwarding section 102 has the function of separating coins C that are stacked in bulk from each other and the function of forwarding the coins C thus separated toward the next step. This section 102 comprises a storing container 200, a rotary disk 202, and a receiver 204.

The rotary disk 202 is obliquely mounted at a predetermined angle and rotated at a predetermined speed. On the upper surface of the disk 202, three coin receiving parts 206*a*, 206*b*, and 206*c* are formed to receive the coins C one by one. Since all the coin receiving parts 206*a*, 206*b*, and 206*c* are the same in structure, the same reference numerals are attached to the structural elements of the parts 206*a*, 206*b*, and 206*c* and at the same time, the parts 206*a*, 206*b*, and 206*c* are distinguished with different suffixes of English alphabet a, b, and c added to the reference numerals in this specification.

In this embodiment, three coin receiving parts 206*a*, 206*b*, and 206*c* are formed on the upper surface of the rotary disk 202. However, the count of the coin receiving parts may be changed appropriately based on the processing speed in the coin discrimination section 104, the processing speed of an external device or devices (not shown) of the coin discrimination apparatus 100, the diameters of the coins C, and so on.

The coin receiving parts 206*a*, 206*b*, and 206*c* have depressions 208*a*, 208*b*, and 208*c* for receiving the coins C and pushers 210*a*, 210*b*, and 210*c* located at inner positions with respect to the depressions 208*a*, 208*b*, and 208*c*, respectively. The depressions 208*a*, 208*b*, and 208*c* have openings 212*a*, 212*b*, and 212*c* formed at the upper side of the disk 202, and openings 214*a*, 214*b*, and 214*c* formed at the peripheral edge side of the disk 202, respectively. The depressions 208*a*, 208*b*, and 208*c* have the same plan shape like a U character.

The pushers 210*a*, 210*b*, and 210*c* are located at one sides of the depressions 208*a*, 208*b*, and 208*c* in such a way as to extend along the inner edges of the depressions 208*a*, 208*b*, and 208*c*, respectively. In the ordinary state where the coins C can be received, one ends of the pushers 210*a*, 210*b*, and 210*c* are respectively located at the sides of the peripheral edge openings 214*a*, 214*b*, and 214*c* of the depressions

208*a*, 208*b*, and 208*c* and at the same time, the other ends of the pushers 210*a*, 210*b*, and 210*c* are respectively located at the positions near the center of the disk 202.

Figure 5:
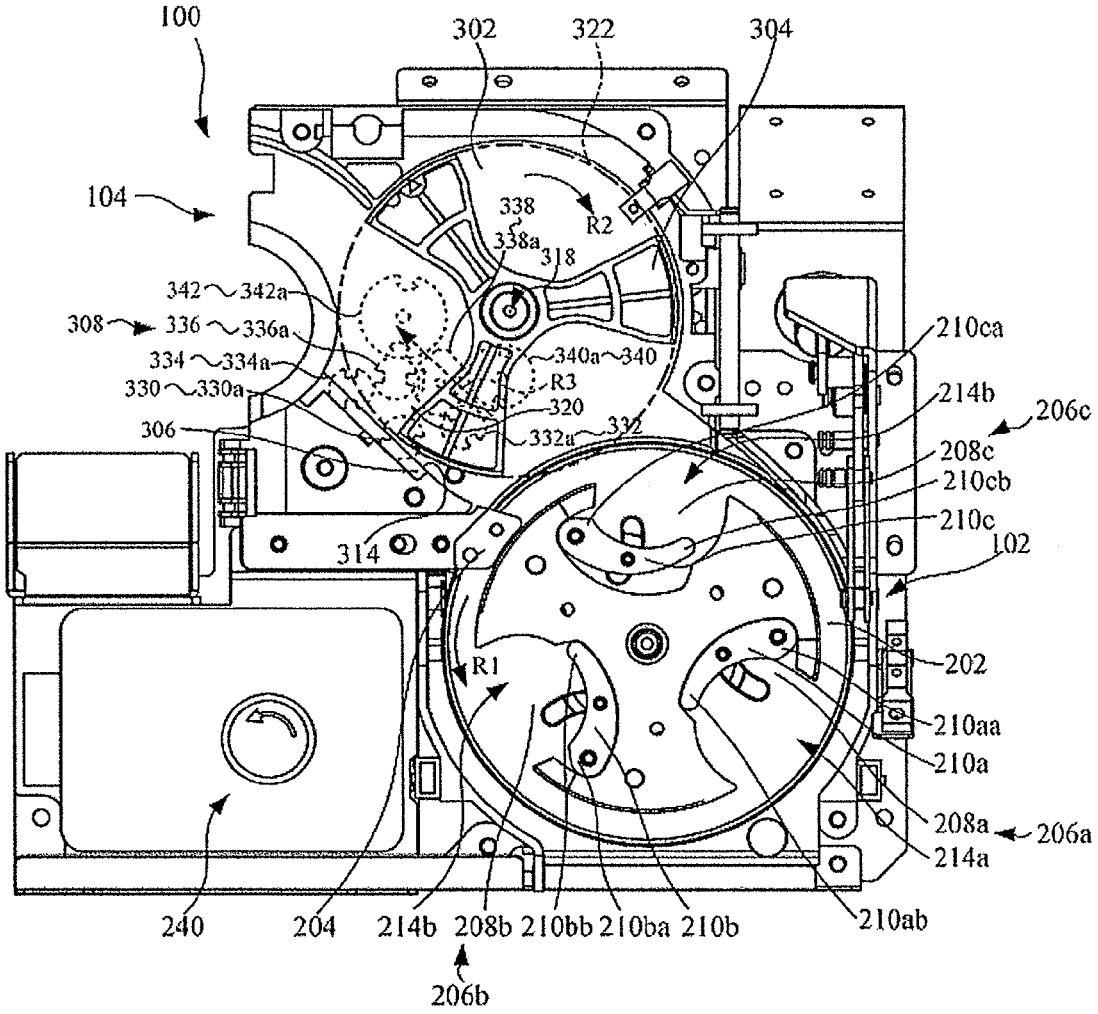
FIG. 5 is a front view of the coin discrimination apparatus according to the embodiment of the present invention, which shows the state where the upper cover of the apparatus is detached.

As clearly shown in FIG. 5, the peripherally positioned ends 210*aa*, 210*ba*, and 210*ca* of the pushers 210*a*, 210*b*, and 210*c*, which are respectively located at the peripheral edge openings 214*a*, 214*b*, and 214*c*, are rockably supported by the disk 202. The pushers 210*a*, 210*b*, and 210*c* are configured in such a way that the pushers 210*a*, 210*b*, and 210*c* are respectively pivoted on their ends 210*aa*, 210*ba*, and 210*ca* in conjunction with the rotation of the disk 202 and that the internally-positioned ends 210*ab*, 210*bb*, and 210*cb* of the pushers 210*a* 1 210*b* 1 and 210*c* are respectively moved toward the peripheral edge openings 214*a* 1 214*b* 1 and 214*c* due to their pivot movements.

The sizes (widths) of the coin receiving parts 206*a*, 206*b* 1 and 206*c* are set to be equal to or greater than the diameter of a maximum diameter coin and less than twice as much as the diameter of a minimum diameter coin. The heights of the coin receiving parts 206*a* 1 206*b*/and 206*c* are set to be equal to or less than the thickness of a thinnest coin. Therefore, in the state where two or more coins C are aligned in parallel to the upper surface of the disk 202 1 these coins C are unable to be received by each of the coin receiving parts 206*a* 1 206*b* 1 and 206*c*. Moreover I even if two or more coins C are stacked perpendicular to the upper surface of the disk 202 1 the coin or coins C other than the lowest-positioned one is/are unable to be received by each of the coin receiving parts 206*a* 1 206*b*, and 206*c*.

Because of the aforementioned structure of the coin receiving parts 206*a* 1 206*b* 1 and 206C 1 only a single coin C is received by each of the coin receiving parts 206*a* 1 206*b*, and 206C 1 and the coins C thus received are respectively pushed out through the peripherally positioned openings 214*a*/214*b*/and 214*c* with the pushers 210*a* 1 210*b* 1 and 210*c* that are pivoted in conjunction with the rotation of the disk 202 in the first rotation direction R1. In this way, the coins C thus received are successively forwarded to the next step (i.e., the coin discrimination section 104) from the respective openings 214*a*, 214*b*, and 214*c*.

[Coin Discrimination Section]

Next, the coin discrimination section 104 of the coin discrimination apparatus 100 will be explained below with reference to FIGS. 1 to 8.

The coin discrimination section 104 has the function of discriminating the denomination and authenticity of the coins C sent out from the coin separating and forwarding section 102 one by one. The coin discrimination section 104 comprises a base 302 that supports one of the two surfaces of the coin C, a rotator 304 that pushes the peripheral face of the coin C, a guide 306 that guides linearly the coin C moved by the pushing operation of the rotator 304, and a detecting part (i.e., a coin detector) 308 that detects predetermined physical characteristics of the coin c moved by the pushing operation of the rotator 304.

As shown in FIG. 5, the base 302 is formed by a non-nonmagnetic material such as a synthetic resin. The surface of the base 302 is formed flat. The rotator 304 is placed on the surface of the base 302 so as to be rotatable around a rotation axis perpendicular to the same surface of the base 302. The surface of the base 302 is approximately flush with the upper surface of the rotary disk 202 of the coin separating and forwarding section 102. By these structures, the coins c can be transferred smoothly from the coin separating and forwarding section 102 to the coin discrimination section 104. In other words, the coins C can be carried smoothly to a carrying path 320 by way of the receiver 204 from the coin receiving parts 206*a*, 206*b*, and 206*c* of the coin separating and forwarding section 102. Several strip-like protrusions that extend in the guiding direction of the coins C may be formed on the surface of the base 302 in order to reduce the friction force between the surface of the base 302 and the opposing surface of the coin c.

The rotator 304 has the function of pushing the peripheral face of the coin C that has been received from the coin separating and forwarding section 102 and sending out the coin C thus pushed to the next step. The rotator 304 is formed by a non-magnetic material such as a synthetic resin. The rotator 304, which is placed in parallel to the surface of the base 302, is configured to be rotatable around a rotation axis 318 perpendicular to the surface of the base 302. The rotator 304 comprises three blade-shaped pushing members 316*a*, 316*b*, and 316*c* arranged at equal intervals around the rotation axis 318, where the pushing members 316*a*, 316*b*, and 316*c* are extended in the directions approximately perpendicular to the axis 318 (in other words, extended along the surface of the base 302). Because of the necessity of receiving the coins C that have been sent out one by one from the coin separating and forwarding section 102, the pushing members 316*a*, 316*b*, and 316*c* are respectively provided so as to correspond to the coin receiving parts 206*a*, 206*b*, and 206*c* of the disk 202. In other words, the rotator 304 comprises the pushing members 316*a*, 316*b*, and 316*c* that are respectively provided corresponding to the coin receiving parts 206*a*, 206*b*, and 206*c*. The coins C that have been sent out successively from the coin receiving parts 206*a*, 206*b*, and 206*c* to the receiver 204 are successively pushed by the pushers 210*a*, 210*b*, and 210*c* of the rotator 304 rotating in the second rotation direction R2 and thereafter, these coins C are carried on the carrying path 320 on the base 302.

In addition, the count of the pushing members 316*a*, 316*b*, and 316*c* may be changed appropriately according to the count of the coin receiving parts 206*a*, 206*b*, and 206*c* and/or the relationship between the rotation speed of the disk 202 and the rotation speed of the rotator 304.

Figure 6:
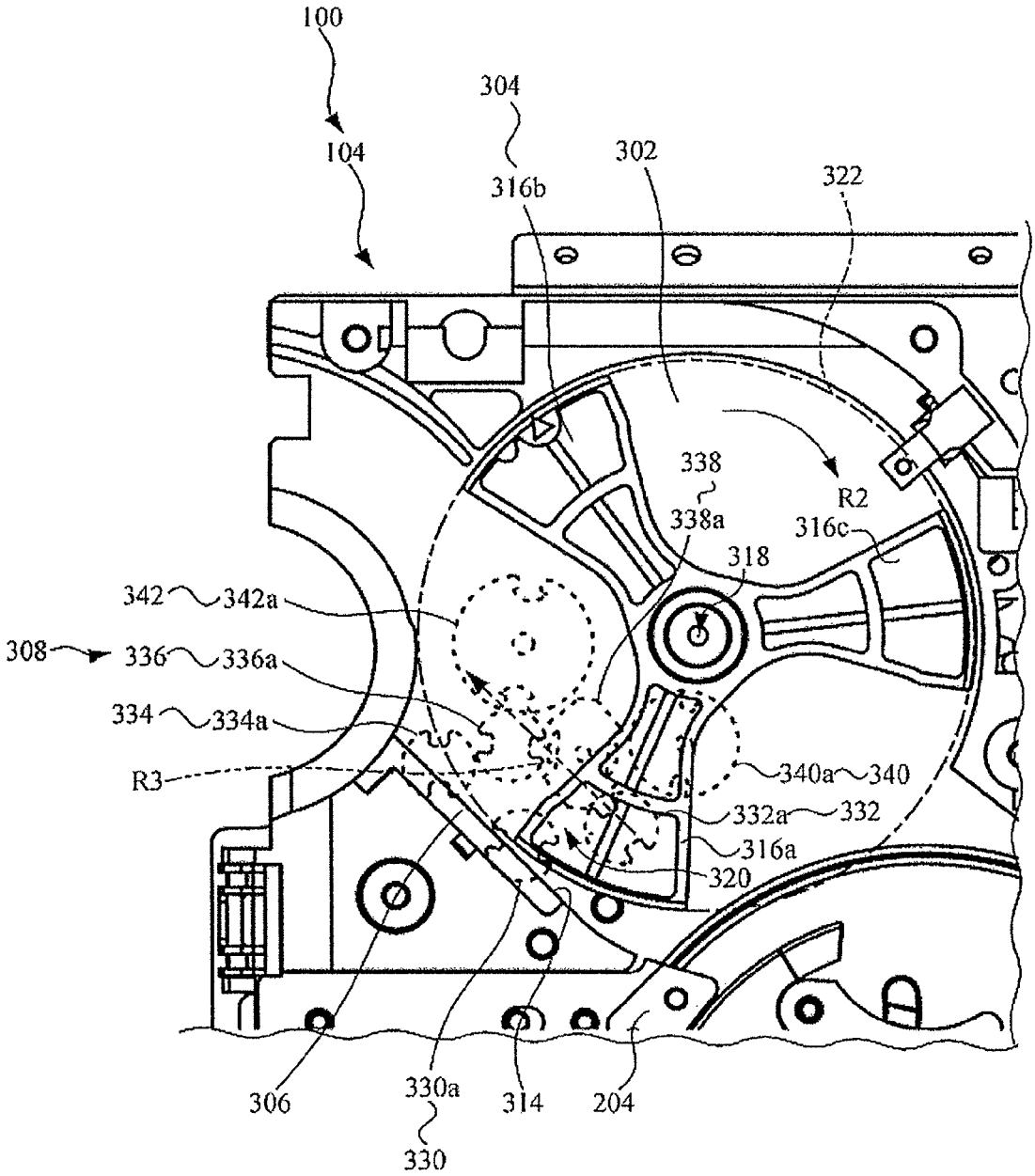
FIG. 6 is an enlarged front view of the coin discrimination section of the coin discrimination apparatus shown in FIG. 5.
Figure 8:
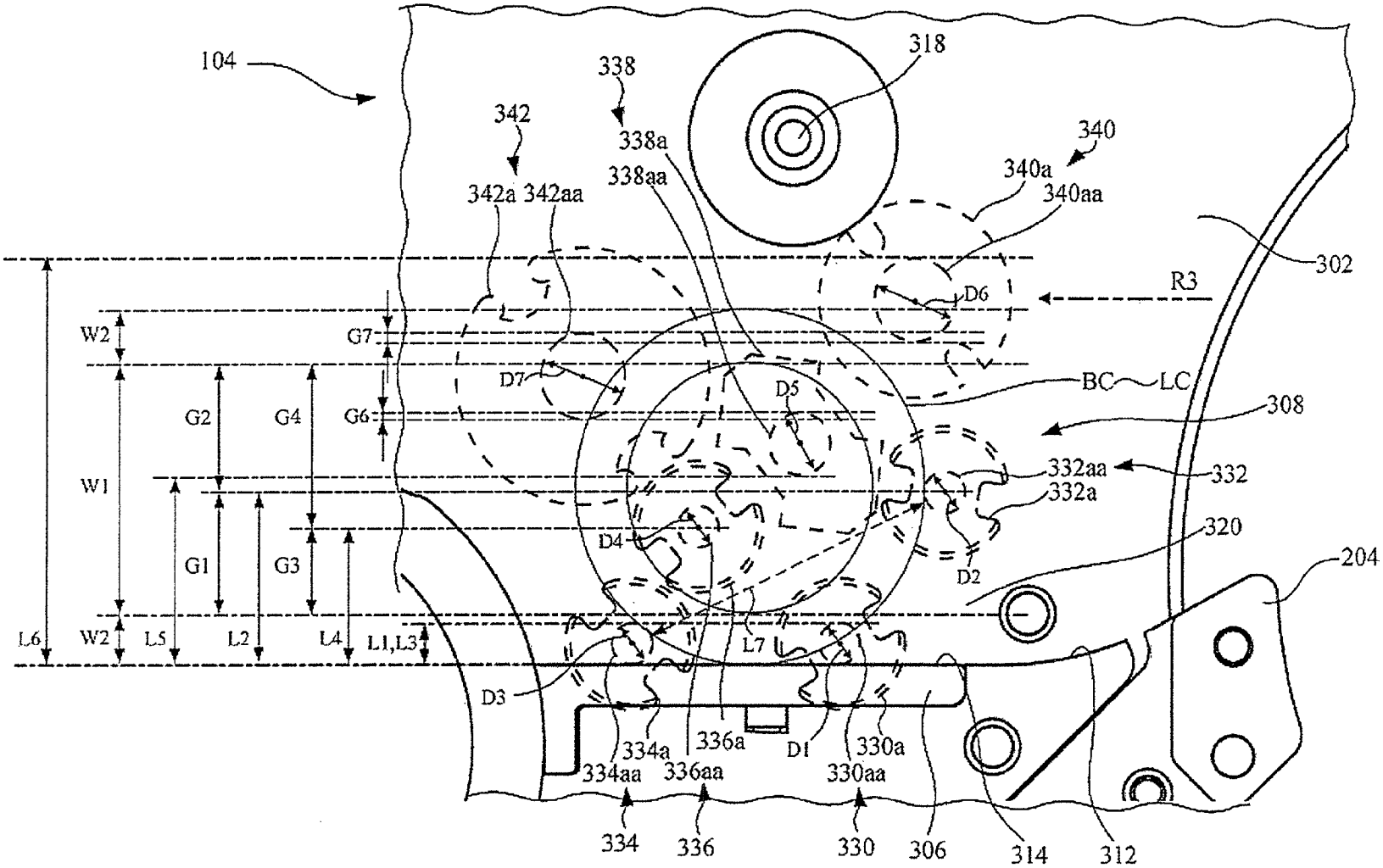
FIG. 8 is an enlarged front view of the detecting part (the coin detector) of the coin discrimination section of the coin discrimination apparatus shown in FIG. 6.

The guide 306, shown in FIGS. 5, 6, and 8, has the function of guiding the peripheral face of a coin C that is pushed and moved by the rotator 304. The guide 306 is located outside the rotation path 322 of the peripheral ends of the pushing members 316*a*, 316*b*, and 316*c* and is placed adjacent to the receiver 204. The guide 306 comprises an arc-shaped part 312 formed so as to be continuous with the receiver 204 in such a way that a small gap is formed between the arc-shaped part 312 and the receiver 204, and a linear part 314 formed so as to be continuous with the arc-shaped part 312. A coin C, which is rotated by the rotator 304 on the base 302, is guided by the linear part 314 of the guide 306 by contacting the peripheral face of the coin C with the linear part 314. By such the structure and operation, the coin C can be guided linearly on the carrying path 320 on the base 302 in the extension direction of the linear part 314, i.e., the carrying direction R3, as shown in FIG. 6.

In addition, although the guide 306 is formed to be separated from the base 302 in this embodiment, the present invention is not limited to this. The guide 306 and the base 302 may be integrated with each other.

The surface of the base 302 is covered with a cover 324. A control section for controlling the operation of the coin discrimination apparatus 100 is placed in the cover 324. The cover 324 is attached to the base 302 in such a way as to be opened and closed. In the closed state, the rotator 304 and the carrying path 320 are covered with the cover 324. In the opened state, the rotator 304 and the carrying path 320 are exposed from the cover 324. The bottom 326 of the cover 324, which is opposite to the surface of the base 302 in the closed state of the cover 324, is formed flat. The clearance between the bottom 326 of the cover 324 and the surface of the base 302 is set to be slightly larger than the maximum thickness of coins C. By this structure, coins c that are moved in conjunction with the rotation of the rotator 304 can be prevented from being displaced in the direction perpendicular to the surface of the base 302, which means that the coins C are carried stably on the carrying path 320 formed on the surface of the base 302.

The detecting part or coin detector 308 comprises a plurality of coin detection sensors and has the function of discriminating the denomination and authenticity of coins C based on the physical characteristics of the coins C obtained by these sensors. In this embodiment, as shown in FIG. 6, the detecting part or coin detector 308 comprises first, second, third, fourth, fifth, sixth, and seventh coin detection sensors 330, 332, 334, 336, 338, 340, and 342. Each of the first to seventh coin detection sensors 330, 332, 334, 336, 338, 340, and 342 is formed by a magnetic sensor comprising a pair of magnetic material cores and coils wound around the respective cores.

Specifically, the first coin detection sensor 330 comprises a pair of magnetic material cores 330*a* and 330*b*, and coils (not shown) which are respectively wound around the central cores 330*aa* and 330*ba* of the cores 330*a* and 330*b*. The second coin detection sensor 332 comprises a pair of magnetic material cores 332*a* and 332*b*, and coils (not shown) which are respectively wound around the central cores 332*aa* and 332*ba* of the cores 332*a* and 332*b*. The third coin detection sensor 334 comprises a pair of magnetic material cores 334*a* and 334*b*, and coils (not shown) which are respectively wound around the central cores 334*aa* and 334*ba* of the cores 334*a* and 334*b*. The fourth coin detection sensor 336 comprises a pair of magnetic material cores 336*a* and 336*b*, and coils (not shown) which are respectively wound around the central cores 336*aa* and 336*ba* of the cores 336*a* and 336*b*. The fifth coin detection sensor 338 comprises a pair of magnetic material cores 338*a* and 338*b*, and coils (not shown) which are respectively wound around the central cores 338*aa* and 338*ba* of the cores 338*a* and 338*b*. The sixth coin detection sensor 340 comprises a pair of magnetic material cores 340*a* and 340*b*, and coils (not shown) which are respectively wound around the central cores 340*aa* and 340*ba* of the cores 340*a* and 340*b*. The seventh coin detection sensor 342 comprises a pair of magnetic material cores 342*a* and 342*b*, and coils (not shown) which are respectively wound around the central cores 342*aa* and 342*ba* of the cores 342*a* and 342*b*.

Figure 7:
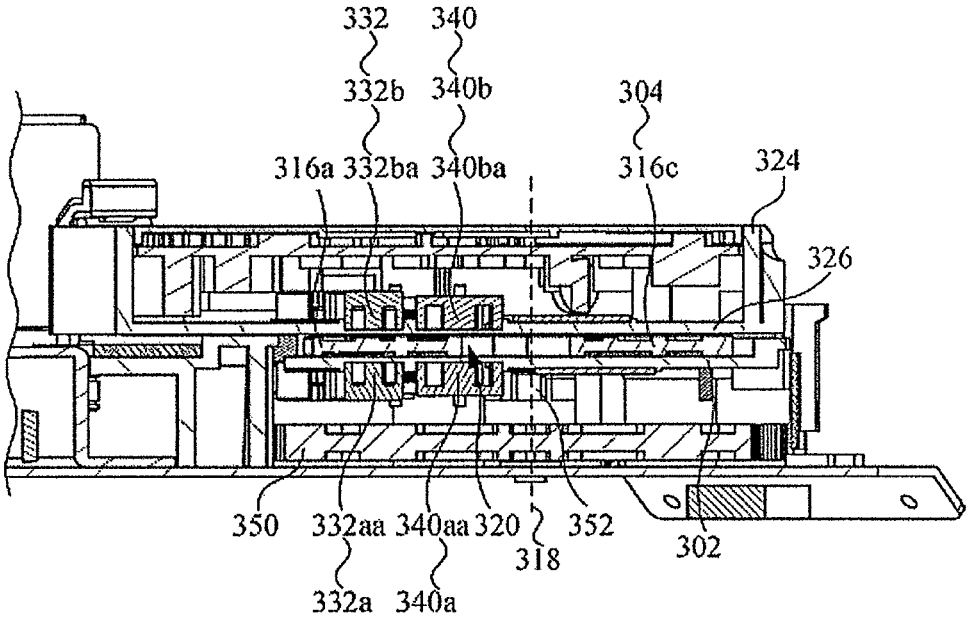
FIG. 7 is a cross-sectional view along the line VII-VII in FIG. 3.

The first to seventh coin detection sensors 330, 332, 334, 336, 338, 340, and 342 are arranged along the carrying path 320 formed on the base 302. As shown in FIG. 7, the magnetic material cores 330*a*, 332*a*, 334*a*, 336*a*, 338*a*, 340*a*, and 342*a* are arranged on the rear side of the base 302. On the other hand, the magnetic material cores 330*b*; 332*b*, 334*b*, 336*b*, 338*b*, 340*b*, and 342*b* are arranged in the cover 324 placed on the front side of the base 302, specifically, on the opposite side of the bottom 326 of the cover 324 to the carrying path 320. Furthermore, the magnetic material cores 330*a*, 332*a*, 334*a*, 336*a*, 338*a*, 340*a*, and 342*a* and the magnetic material cores 330*b*, 332*b*, 334*b*, 336*b*, 338*b*, 340*b*, and 342*b* are respectively opposite to each other in such a way that the carrying path 320 intervenes between the former cores and the latter cores. Accordingly, coins C that are being carried on the carrying path 320 pass through the region sandwiched by the combination of the magnetic material cores 330*a*, 332*a*, 334*a*, 336*a*, 338*a*, 340*a*, and 342*a* and that of the magnetic material cores 330*b*, 332*b*, 334*b*, 336*b*, 338*b*, 340*b*, and 342*b*.

The first and fourth coin detection sensors 330 and 336 are configured to obtain the physical characteristics about the thickness of a coin C carried on the carrying path 320. The second and third coin detection sensors 332 and 334 are configured to obtain the physical characteristics about the material of a coin C carried on the carrying path 320.

As shown in FIG. 8, the first coin detection sensor 330, which is placed near the linear part 314 of the guide 306, is configured in such a way that the pair of central cores 330*aa* and 330*ba* of the first sensor 330 is opposed to the peripheral part of a coin C. The pair of central cores 330*aa* and 330*ba* of the first sensor 330 is arranged in such a way that the guide-side ends of the central cores 330*aa* and 330*ba* are in contact with the linear part 314 of the guide 306. Furthermore, the pair of central cores 330*aa* and 330*ba* is placed in the range where only the peripheral part of a coin C that is carried in the carrying direction R3 passes through, and the diameters D1 of the central cores 330*aa* and 330*ba* are defined in such a way as not to be opposite to the central part of the coin C. In other words, the distance L1 from the linear part 314 of the guide 306 to the opposite ends (i.e., the remote-side ends) of the central cores 330*aa* and 330*ba* to the guide 306 is defined.

The second coin detection sensor 332, which is distant from the first coin detection sensor 330, is configured in such a way that the pair of central cores 332*aa* and 332*ba* of the second sensor 332 is opposed to the central part of a coin C. In other words, the distance L2 from the linear part 314 of the guide 306 to the centers of the central cores 332*aa* and 332*ba* and the diameter D2 of the central cores 332*aa* and 332*ba* are defined in such a way that the pair of central cores 332*aa* and 332*ba* is placed in the range where the central part of a coin C that is carried in the carrying direction R3 passes through, and that the pair of central cores 332*aa* and 332*ba* is not opposed to the peripheral part of the coin C.

The third coin detection sensor 334 is placed on the downstream side of the carrying path 320 at a predetermined distance with respect to the first coin detection sensor 330. Moreover, the third sensor 334, which is placed near the linear part 314 of the guide 306, is configured in such a way that the pair of central cores 334*aa* and 334*ba* of the third sensor 334 is opposed to the peripheral part of a coin C. The central cores 334*aa* and 334*ba* are placed in such a way that the guide-side ends of the central cores 334*aa* and 334*ba* are contacted with the linear part 314 of the guide 306. Furthermore, the diameters D3 of the central cores 334*aa* and 334*ba* are defined in such a way that the pair of central cores 334*aa* and 334*ba* is placed in the range where only the peripheral part of a coin C that is carried in the carrying direction R3 passes through, and that the pair of central cores 334*aa* and 334*ba* is not opposed to the central part of the coin C. In other words, the distance L3 from the linear part 314 of the guide 306 to the opposite ends (i.e., the remote-side ends) of the central cores 334*aa* and 334*ba* to the guide 306 is defined.

The fourth coin detection sensor 336 is placed on the downstream side of the carrying path 320 at a predetermined distance with respect to the second coin detection sensor 332. The fourth sensor 336, which is distant from the guide 306 with respect to the third coin detection sensor 334, is configured in such a way that the pair of central cores 336*aa* and 336*ba* of the fourth sensor 336 is opposed to the central part of a coin C. In other words, the distance L4 from the linear part 314 of the guide 306 to the centers of the central cores 336*aa* and 336*ba* and the diameters D4 of the central cores 336*aa* and 336*ba* are defined in such a way that the pair of central cores 336*aa* and 336*ba* is placed in the range where the central part of a coin C that is carried in the carrying direction R3 passes through 1 and that the pair of central cores 336*aa* and 336*ba* is not opposed to the peripheral part of the coin C.

Due to the aforementioned configurations of the first to fourth coin detection sensors 330, 332, 334 1 and 336, the physical characteristic about the thickness of only the peripheral part of the coin C can be obtained by the first sensor 330, the physical characteristic about the material of only the central part of the coin C can be obtained by the second sensor 332 1 the physical characteristic about the material of only the peripheral part of the coin C can be obtained by the third sensor 334, and the physical characteristic about the thickness of only the central part of the coin C can be obtained by the fourth sensor 336.

Moreover, with respect to the second and third sensors 332 and 334, the interval L7 between the pair of central cores 332*aa* and 332*ba* of the second sensor 332 and the pair of central cores 334*aa* and 334*ba* of the third sensor 334 is defined in such a way that the peripheral edge of the maximum diameter coin LC within target coins C to be discriminated is also faced with the pair of central cores 332*aa* and 332*ba* of the second sensor 332 when the peripheral edge of the maximum diameter coin LC is faced with the pair of central cores 334*aa* and 334*ba* of the third sensor 334. The coils wound around the pair of magnetic material cores 332*a* and 332*b* of the second sensor 332 are electrically connected in series to the coils wound around the pair of magnetic material cores 334*a* and 334*b* of the third sensor 334 1 respectively. By such the structure 1 the physical characteristics about the material and diameter of the peripheral part of the coin C can be obtained by cooperation of the second and third sensors 332 and 334.

Accordingly, by using the physical characteristics about the material and diameter of the peripheral part of a coin c obtained by the cooperation of the second and third sensors 332 and 334 for coin discrimination in addition to the physical characteristics about the thickness and material of the peripheral and central parts of the coin C obtained by the first to fourth sensors 330/and 3361 the denomination and authenticity of the coin c can be discriminated more accurately than the case where the physical characteristics about the material and diameter of the peripheral part of the coin C obtained by the cooperation of the second and third sensors 332 and 334 are excluded.

Here, a case for discriminating a bimetallic coin BC such as a one or two Euro coin will be explained below as an example.

The first coin detection sensor 330 is located in the vicinity of the linear part 314 of the guide 306 in such a way that the pair of central cores 330*aa* and 330*ba* are opposed to the ring-shaped part (i.e., the peripheral part) of a bimetallic coin BC. In other words, the pair of central cores 330*aa* and 330*ba* is placed in the range where only the ringshaped part of the bimetallic coin BC passes through and the connecting portion of the core part (i.e., the central part) and the ring-shaped part of the bimetallic coin BC does not pass through. The guide-side ends of the central cores 330*aa* and 330*ba* are arranged so as to be contacted with the linear part 314 of the guide 306. The diameters D1 of the central cores 330*aa* and 330*ba* are set to be smaller than the width W2 of the ring-shaped part of the bimetallic coin BC (i.e., D1<W2) in such a way that the central cores 330*aa* and 330*ba* are not opposed to the connecting portion of the core and ringshaped parts of the bimetallic coin BC. In other words, the distance L1 between the linear part 314 of the guide 306 to the remote-side ends of the central cores 330*aa* and 330*ba* is set to be smaller than the width W2 of the ring-shaped part of the bimetallic coin BC (L1<W2). By such the relationship, the physical characteristics about the thickness of only the ring-shaped part of the coin BC can be obtained by the first sensor 330. Therefore, the effect to the physical characteristic about the thickness of the ring-shaped part of the coin BC obtained by the first sensor 330, which is applied by the dispersion or variations in physical characteristic about the thickness of the coin BC caused by the structural unevenness of the connecting portion thereof, can be prevented.

In addition, in the coin discrimination apparatus 100 according to this embodiment, the diameters D1 of the central cores 330*aa* and 330*ba* are set to be equal to the distance L1 between the linear part 314 of the guide 306 and the opposite ends (i.e., the remote-side ends) of the central cores 330*aa* and 330*ba* (i.e., D1=L1). However, the present invention is not limited to this. The diameters D1 may be changed appropriately if the distance L1 is set to be smaller than the width W2; this is because it is sufficient that the central cores 330*aa* and 330*ba* are configured so as not to be opposed to the connecting portion of the core and ring-shaped parts of the bimetallic coin BC.

The second sensor 332 is located in such a way that the central cores 332*aa* and 332*ba* are opposed to the core part of the bimetallic coin BC. In other words, the central cores 332*aa* and 332*ba* are arranged in the range where the core part of the coin BC that is carried in the carrying direction R3 passes through. The distance L2 between the linear part 314 of the guide 306 and the centers of the central cores 332*aa* and 332*ba* is set to be larger than the width W2 of the ring-shaped part of the coin BC and smaller than the sum of the diameter W1 of the core part of the coin BC and the width W2 of the ring-shaped part thereof (i.e., W1<L2<W1+W2). The diameters D2 of the central cores 332*aa* and 332*ba* of the second sensor 332 are set to be smaller than twice as much as smaller one of the distance G1 from the centers of the central cores 332*aa* and 332*ba* to the guide-side end of the core part of the coin BC in the direction perpendicular to the linear part 314 of the guide 306, and the distance G2 from the centers of the central cores 332*aa* and 332*ba* to the remoteside end of the core part of the coin BC in the direction perpendicular to the linear part 314 of the guide 306. Specifically, when the distance G1 is smaller than the distance G2, (i.e., G1<G2), the diameter D2 is set to be smaller than twice as much as the distance G1 (i.e., D2<G1×2). On the other hand, when the distance G2 is smaller than the distance G1 (i.e., G2<G1), the diameter D2 is set to be smaller than twice as much as the distance G2 (i.e., D2<G2×2). By such the structure, the centers of the central cores 332*aa* and 332*ba* can be opposed to only the core portion of the coin BC in the process of carrying the coin BC in the carrying direction R3. Therefore, the physical characteristic about the material of only the core part of the coin BC can be obtained by the second sensor 332. Accordingly, the effect to the physical characteristic about the material of the core part of the coin BC obtained by the second sensor 332, which is applied by the dispersion or variations in physical characteristic about the material of the coin BC caused by the structural unevenness of the connecting portion thereof, can be prevented.

The third sensor 334 is placed on the downstream side of the carrying path 320 with respect to the first sensor 330. Moreover, the third sensor 334, which is placed near the linear part 314 of the guide 306, is configured in such a way that the pair of central cores 334*aa* and 334*ba* is opposed to the ring-shaped part of the bimetallic coin BC. In other words, the central cores 334*aa* and 334*ba* are arranged in the range where only the ring-shaped part of the coin BC passes through and the connecting portion of the core and ring-shaped parts of the coin BC does not pass through. The guide-side ends of the central cores 334*aa* and 334*ba* are in contact with the linear part 314 of the guide 306. The diameters D3 of the central cores 334*aa* and 334*ba* are set to be smaller than the width W2 of the ring-shaped part of the coin BC (i.e., D3<W2) in order for the central cores 334*aa* and 334*ba* not to be opposed to the connecting portion of the core and ring-shaped parts of the coin BC. In other words, the distance L3 from the linear part 314 of the guide 306 to the remote-side ends of the central cores 334*aa* and 334*ba* is set to be smaller than the width W2 of the ring-shaped part of the coin BC (i.e., L3<W2). Therefore, the physical characteristic about the material of only the ring-shaped part of the coin BC can be obtained by the third sensor 334. Accordingly, the effect to the physical characteristic about the material of the ring-shaped part of the coin BC obtained by the third sensor 334, which is applied by the dispersion or variations in physical characteristic about the material of the coin BC caused by the structural unevenness of the connecting portion thereof, can be prevented.

In addition, in the coin discrimination apparatus 100 according to this embodiment, the diameters D3 of the central cores 334*aa* and 334*ba* are set to be equal to the distance L3 between the linear part 314 of the guide 306 and the remoteside ends of the central cores 334*aa* and 334*ba* (i.e., D3=L3). However, the present invention is not limited to this. The diameters D3 may be changed appropriately if the distance L3 is set to be smaller than the width W2; this is because it is sufficient that the central cores 334*aa* and 334*ba* are configured so as not to be opposed to the connecting portion of the core and ring-shaped parts of the bimetallic coin BC.

Further in addition, in the coin discrimination apparatus 100 according to this embodiment, the diameters D1 of the central cores 330*aa* and 330*ba* are set to be equal to the diameters D3 of the central cores 334*aa* and 334*ba* (i.e., D1=D3). However, the present invention is not limited to this. The diameters D1 and D3 may be changed appropriately.

The fourth sensor 336 is placed in such a way that the pair of central cores 336*aa* and 336*ba* is opposed to the core part of the bimetallic coin BC. In other words, the central cores 336*aa* and 336*ba* are arranged in the range where the core part of the coin BC that is carried in the carrying direction R3 passes through. The distance L4 between the linear part 314 of the guide 306 and the centers of the central cores 336*aa* and 336*ba* is set to be larger than the width W2 of the ringshaped part of the coin BC and smaller than the sum of the diameter W1 of the core part of the coin BC and the width W2 of the ring-shaped part thereof (i.e., W1<L4<W1+W2). The diameters D4 of the central cores 336*aa* and 336*ba* of the fourth sensor 336 are set to be smaller than twice as much as smaller one of the distance G3 from the centers of the central cores 336*aa* and 336*ba* to the guide-side end of the core part of the bimetallic coin BC in the direction perpendicular to the linear part 314 of the guide 306, and the distance G4 from the centers of the central cores 336*aa* and 336*ba* to the remote-side end of the core part of the coin BC in the direction perpendicular to the linear part 314 of the guide 306. Specifically, when the distance G3 is smaller than the distance G4, (i.e., G3<G4), the diameter D4 is set to be smaller than twice as much as the distance G3 (i.e., D4<G3×2). On the other hand, when the distance G4 is smaller than the distance G3 (i.e., G4<G3), the diameter D4 is set to be smaller than twice as much as the distance G4 (i.e., D4<G4×2). By such the structure, the centers of the central cores 336*aa* and 336*ba* can be made opposed to only the core portion of the coin BC in the process of carrying the coin BC in the carrying direction R3. Therefore, the physical characteristic about the thickness of only the core part of the coin BC can be obtained by the fourth sensor 336. Accordingly, the effect to the physical characteristic about the thickness of the core part of the coin BC obtained by the fourth sensor 336, which is applied by the dispersion or variations in physical characteristic about the thickness of the coin BC caused by the structural unevenness of the connecting portion thereof, can be prevented.

Because of the aforementioned structures and relationships, without being affected by the structural unevenness of the connecting portion of the bimetallic coin BC, the physical characteristic about the thickness of the ring-shaped part of the coin BC is obtained by the first sensor 330, the physical characteristic about the material of the core part of the coin BC is obtained by the second sensor 332, the physical characteristic about the material of the ring-shaped part of the coin BC is obtained by the third sensor 334, and the physical characteristic about the thickness of the core part of the coin BC is obtained by the fourth sensor 336. This means that the effect of the structural unevenness of the connecting portion of the coin BC can be avoided in any of the first to fourth sensors 330, 332, 334, and 336. Accordingly, unlike the case where the physical characteristic about one of the thickness and material of the core and ring-shaped parts of a bimetallic coin is obtained by a single coin detection sensor, the physical characteristics of the thickness and material of the core and ring-shaped parts of the bimetallic coin BC can be obtained in detail, which means that the denomination and authenticity of the bimetallic coin BC can be discriminated with high accuracy.

Moreover, the second and third sensors 332 and 334 are arranged in such a way that the central cores 332*aa* and 332*ba* of the second sensor 332 also are opposed to the peripheral part or edge of the bimetallic coin BC when the peripheral edge of the coin BC reaches the central cores 334*aa* and 334*ba* of the third sensor 334. In other words, the distance L7 between the central cores 332*aa* and 332*ba* of the second sensor 332 and the central cores 334*aa* and 334*ba* of the third sensor 334 is defined in such a way that the central cores 332*aa* and 332*ba* and the central cores 334*aa* and 334*ba* are simultaneously opposed to the peripheral edge of the bimetallic coin BC. By such the structure, not only the physical characteristic about the material of the ring-shaped part of the bimetallic coin BC but also the physical characteristic about the diameter of the coin BC can be obtained by the cooperation of the second and third sensors 332 and 334.

Accordingly, by using the physical characteristics about the material and diameter of the bimetallic coin BC obtained by the cooperation of the second and third sensors 332 and 334 for coin discrimination in addition to the physical characteristics about the thickness and material of the ring-shaped and core parts of the coin BC obtained by the first to fourth sensors 330, 332, 334, and 336, the denomination and authenticity of the coin BC can be discriminated more accurately than the case where only the physical characteristics about the material and thickness of the ring-shaped and core parts of the coin BC obtained by the first to fourth sensors 330, 332, 334, and 336 are used.

In the coin discrimination section 104 of the coin discrimination apparatus 100 according to this embodiment, the physical characteristics about the thickness of the coin c are obtained by the first and fourth sensors 330 and 336 and the physical characteristics about the material of the coin C are obtained by the second and third sensors 332 and 334. However, the present invention is not limited to this. The physical characteristics about the material of the coin C may be obtained by the first and fourth sensors 330 and 336 and the physical characteristics about the thickness of the coin C may be obtained by the second and third sensors 332 and 334.

Moreover, similar to the second and third sensors 332 and 334, the physical characteristics about the coin C may be obtained by the cooperation of the first and fourth sensors 330 and 336 by connecting the coils of the first and fourth sensors 330 and 336 in series. Furthermore, the positions and sizes of the central cores 330*aa*, 330*ba*, 332*aa*, 332*ba*, 334*aa*, 334*ba*, 336*aa*, and 336*ba* of the first to fourth sensors 330, 332, 334, and 336, concretely speaking, each of the distances L1, L2, L3, L4, and L7 and the diameters D1, D2, D3, and D4, may be changed appropriately according to the diameter, material, and so on of a target coin C to be discriminated.

The fifth, sixth, and seventh sensors 338, 340, and 342 have the function of acquiring the physical characteristic about the diameter of a coin C in the state where the fifth, sixth, and seventh sensors 338, 340, and 342 are opposed to the opposite peripheral edge (i.e., the remote-side peripheral edge) of a coin C that is carried on the carrying path 320 to the guide 306.

The fifth sensor 338 is located to acquire the physical characteristic of a diameter of a minimum diameter coin SC. Specifically, the pair of central cores 338*aa* and 338*ba* of the fifth sensor 338 is located in such a way as to be opposed to the remote-side peripheral edge of the minimum diameter coin SC. In other words, the distance L5 between the guide-side end of the central cores 338*aa* and 338*ba* of the fifth sensor 338 and the linear part 314 of the guide 306 is set to be smaller than the diameter of the minimum diameter coin SC.

The sixth sensor 340 is located to acquire the physical characteristic of a diameter of a maximum diameter coin LC. Specifically, the pair of central cores 340*aa* and 340*ba* of the sixth sensor 340 is located in such a way as to be opposed to the remote-side peripheral edge of the maximum diameter coin LC. In other words, the distance L6 between the remote-side ends of the central cores 340*aa* and 340*ba* of the sixth sensor 340 and the linear part 314 of the guide 306 is set to be larger than the diameter of the maximum diameter coin LC.

The seventh sensor 342 is placed on the downstream side of the carrying path 320 with respect to the fifth and sixth sensors 338 and 340. Moreover, the central cores 342*aa* and 342*ba* of the seventh sensor 342 are arranged between the central cores 338*aa* and 338*ba* of the fifth sensor 338 and the central cores 340*aa* and 340*ba* of the sixth sensor 340 in the direction which is perpendicular to the extension direction of the linear part 314 of the guide 306 and which is parallel to the surface of the base 302.

By such the structure, the physical characteristic about the diameter of a relatively small diameter coin c can be obtained by the fifth sensor 338, the physical characteristic about the diameter of a relatively large diameter coin C can be obtained by the sixth sensor 340, and the physical characteristic about the diameter of a relatively middle diameter coin C can be obtained by the seventh sensor 342.

The fifth and seventh sensors 338 and 342 are arranged in such a way that the remote-side ends of the central cores 338*aa* and 338*ba* of the fifth sensor 338 and the guide-side ends of the central cores 342*aa* and 342*ba* of the seventh sensor 342 are overlapped with each other by a predetermined length G5 in the direction which is perpendicular to the extension direction of the linear part 314 of the guide 306 and which is parallel to the surface of the base 302. The sixth and seventh sensors 340 and 342 are arranged in such a way that the guide-side ends of the central cores 340*aa* and 340*ba* of the sixth sensor 340 and the remote-side ends of the central cores 342*aa* and 342*ba* of the seventh sensor 342 are overlapped with each other by a predetermined length G6 in the direction which is perpendicular to the extension direction of the linear part 314 of the guide 306 and which is parallel to the surface of the base 302.

By such the structure of the fifth to seventh sensors 338, 340, and 342, the physical characteristic about the diameter of a coin C can be obtained by the fifth to seventh sensors 338, 340, and 342 even in the state where the boundary between the central cores 338*aa* and 338*ba* of the fifth sensor 338 and the central cores 342*aa* and 342*ba* of the seventh sensor 342 and the boundary between the central cores 340*aa* and 340*ba* of the sixth sensor 340 and the central cores 342*aa* and 342*ba* of the seventh sensor 342 are opposed to the peripheral edge of the coin C.

The fifth to seventh sensors 338, 340, and 342 are arranged in such a way that the physical characteristic about the diameter of a relatively small diameter coin C can be obtained by the fifth sensor 338, the physical characteristic about the diameter of a relatively large diameter coin C can be obtained by the sixth sensor 340, and the physical characteristic about the diameter of a relatively middle diameter coin C can be obtained by the seventh sensor 342 within the target coins c to be discriminated. This means that the physical characteristic about the diameter of a coin C is obtained by one of the fifth to seventh sensors 338, 340, and 342 according to the diameter value of a coin C. Accordingly, compared with the case where the physical characteristic about the diameter of a coin is obtained by a single coin detection sensor, the physical characteristic about the diameter of a coin C can be obtained in more detail, which means that the denomination and authenticity of a coin c can be discriminated with higher accuracy by using the physical characteristic about the diameter of the coin C obtained by the second and third sensors 332 and 334 along with the physical characteristics about the diameter of the coin C obtained respectively by the fifth to seventh sensors 338, 340, and 342.

In addition, the arrangements or layouts of the first to seventh coin detection sensors 330, 332, 334, 336, 338, 340, and 342 may be changed appropriately according to the length of the carrying path 320, the diameter of target coins to be discriminated and so on. For example, the fifth to seventh sensors 338, 340, and 342 may be arranged on the downstream side of the carrying path 320 with respect to the first to fourth sensors 330, 332 334, and 336. The second and third sensors 332 and 334 may be arranged on the downstream side of the carrying path 320 with respect to the first to fourth sensors 330, 332 334, and 336.

[Driving Mechanism]

Next, the driving mechanism 106 of the coin discrimination apparatus 100 will be explained below with reference to FIG. 9.

The driving mechanism 106 has the function of driving or rotating the rotary disk 202 of the coin separating and forwarding section 102 and the rotator 304 of the coin discrimination section 104. The driving mechanism 106 comprises a driving gear 242 that receives driving power from a driving source 240, a first driven gear 244 that rotates the disk 202, and a second driven gear 350 that rotates the rotator 304.

The driving gear 242 is connected to the output shaft of a motor (not shown) as the driving source 240. The first driven gear 244, which is in the form of a spur gear, is integrally configured with the disk 202 on the rear side of the disk 202. Therefore, the disk 202 is rotated along with the rotation of the first driven gear 244. Moreover, the second driven gear 350, which is in the form of a spur gear, is placed on the rear side of the base 302. The second driven gear 350 is configured to be rotatable around the rotation axis 318, and is fixed to the rotator 304 with a rotational shaft 352 penetrating through the base 302 along the rotation axis 318. Therefore, the rotator 304 is rotated along with the rotation of the second driven gear 350.

In the driving mechanism 106, the first driven gear 244 is drivingly connected to the driving gear 242, and the second driven gear 350 is drivingly connected to the first driven gear 244. For this reason, if the driving gear 242 is rotated in the second rotation direction R2, the first driven gear 244 is rotated in the first rotation direction R1. If the first driven gear 244 is rotated in the first rotation direction R1, the second driven gear 350 is rotated in the second rotation direction R2. Accordingly, the first driven gear 244 and the disk 202 are rotated in the first direction R1 along with the rotation of the driving gear 242 in the second direction R2 and then, the second driven gear 350 and the rotator 304 are rotated in the second direction R2.

The gear ratio of the first and second driven gears 244 and 350 is fixed at 1 1. The rotation of the disk 202 and the rotation of the rotator 304 are synchronized in such a way that coins C are rotated by the pushing members 316*a*, 316*b*, and 316*c* of the rotator 304 immediately after the coins C which have been sent out from each of the coin receiving parts 206*a*, 206*b*, and 206*c* are received by the receiver 204.

The gear ratio of the first and second driven gears 244 and 350 is not limited to 1 1 and may be changed appropriately according to the ratio between the count of the coin receiving parts 206 of the disk 202 and the count of the pushing members 316 of the rotator 304.

[Advantageous Effects of Coin Discrimination Apparatus]

With the coin discrimination apparatus 100 according to the embodiment of the present invention, as explained above in detail, the base 302 having the carrying path 320, the rotator 304 for carrying coins C on the carrying path 320 one by one, the guide 306 for guiding the coins C along the carrying path 320, and the coin detector 308 for detecting physical characteristics of the coins C are provided. The coins C that are moved on the carrying path 320 are carried to a predetermined position through the coin detector 308 itself or through the vicinity of the coin detector 308. The coins C that are carried on the carrying path 320 due to the rotation of the rotator 304 are guided by contacting the peripheral face pf the coin C with the guide 306.

The coin detector 308 comprises the first to fourth coin detection sensors 330, 332, 334, and 336, which are located at different positions with respect to the guide 306. This means that the positions of the first to fourth coin detection sensors 330, 332, 334, and 336 are respectively determined using the guide 306 as a reference. Moreover, the coin C that is moved on the carrying path 320 is guided by contacting the peripheral face of the coin c with the guide 306 that extends along the carrying path 320.

Therefore, the positional relationships between each of the coins C that are carried on the carrying path 320 with the first to fourth coin detection sensors 330, 332, 334, and 336 are kept approximately the same for all the coins C thus carried. Accordingly, the physical characteristics about the peripheral and core parts of the coin C that is moved on the carrying path 320 can be detected accurately with the first to fourth coin detection sensors 330, 332, 334, and 336.

Furthermore, the additional physical characteristic about the peripheral part of the coin C that is moved on the carrying path 320 is obtained by cooperation of the second and third coin detection sensors 332 and 334 when the coin C that is moved on the carrying path 320 reaches the third coin detection sensor 334. This means that the physical characteristics about the different positions of the peripheral part of the coin C can be detected by the second and third coin detection sensors 332 and 334 approximately simultaneously. For this reason, coin discrimination can be performed using not only the physical characteristics obtained by the first to fourth coin detection sensors 330, 332, 334, and 336 but also the additional physical characteristic obtained by the cooperation of the second and third coin detection sensors 332 and 334.

Accordingly, the denomination and authenticity of the coins C can be discriminated more accurately compared with the case where the additional physical characteristic is not obtained by the cooperation of the second and third coin detection sensors 332 and 334.

In the case of discriminating a bimetallic coin BC comprising a ring-shaped part (i.e., a peripheral part) and a core part (i.e., a central part) which are made of different materials or different-composition materials (e.g., different metals and/or alloys), the physical characteristics about the peripheral part of the bimetallic coin BC are respectively obtained by the first and third coin detection sensors 330 and 334 at different positions, and the physical characteristics about the central part of the bimetallic coin BC are respectively obtained by the second and fourth coin detection sensors 332 and 336 at different positions. Moreover, the additional physical characteristic about the peripheral part of the bimetallic coin BC is obtained by cooperation of the second and third coin detection sensors 332 and 334.

Therefore, even if the connecting portion of the bimetallic coin BC, which connects the ring-shaped part (peripheral part) and the core part (central part), includes some structural unevenness, the physical characteristics obtained by the first to fourth coin detection sensors 330, 332, 334, and 336 and the additional physical characteristic obtained by cooperation of the second and third coin detection sensors 332 and 334 are unlikely to be affected by the structural unevenness of the connecting portion.

Accordingly, the denomination and authenticity of coins C can be discriminated with high accuracy even if they are bimetallic coins BC.

Furthermore, in the aforementioned coin discrimination apparatus 100 according to this embodiment, the coin detector 308 further comprises the fifth, sixth, and seventh coin detection sensors 338, 340, and 342. The fifth coin detection sensor 338 is located at a further position from the guide 306 than the second and fourth coin detection sensors 332 and 336. The sixth coin detection sensor 340 is located at a further position from the guide 306 than the fifth coin detection sensor 338. The seventh coin detection sensor 342 is located on the downstream side of the carrying path 320 with respect to the fifth and sixth coin detection sensors 338 and 340. Each of the fifth to seventh coin detection sensors

338, 340, and 342 has the function of obtaining the physical characteristic about the diameter of the coin C that is moved on the carrying path 320.

Accordingly, the physical characteristic about the diameter of the coin c having a relatively small diameter is obtained by the fifth coin detection sensor 338, the physical characteristic about the diameter of the coin c having a relatively large diameter is obtained by the sixth coin detection sensor 340, and the physical characteristic about the diameter of the coin having a relatively middle diameter is obtained by the seventh coin detection sensor 342. Thus, compared with the case where the physical characteristic about the diameter of the coin C is obtained by a single coin detection sensor, the physical characteristics about the diameter of the coin C can be obtained in more detail.

As a result, there is an additional advantage that the denomination and authenticity of the coin can be discriminated with higher accuracy than the case where the coin detector 308 does not comprise the fifth, sixth, and seventh coin detection sensors 338, 340, and 342.

Variations

It is needless to say that the present invention is not limited to the above-described embodiment and its variations. Any other modification is applicable to the embodiment and variations.

For example, in the aforementioned coin discrimination apparatus 100 according to the embodiment of the present invention, the structure of the coin separating and forwarding section 102 is not limited to the one explained in this embodiment. For example, the coin separating and forwarding apparatus disclosed in the Japanese Non-Examined Patent Publication No. 2014-041396 may be used for the coin separating and forwarding section 102. The coin separating and forwarding apparatus of the Publication No. 2014-041396 comprises a moving member that is reciprocated linearly along the diameter direction of a rotary disk in conjunction with the rotation of the disk. Coins C are separated from each other by the moving member and then, forwarded to the next process.

The structural elements and their shapes and sizes are preferred examples of the present invention; it is needless to say that any other structural elements may be used and these shapes and sized may be changed according to the necessity.

The present invention is applicable to any type of coin processing apparatuses for processing coins. For example, the present invention may be preferably applied to change machines, money changers, vending machines, automated teller machines, ticket-vending machines and so on.

While the preferred forms of the present invention have been described, it is to be understood that modifications will be apparent to those skilled in the art without departing from the spirit of the invention. The scope of the present invention, therefore, is to be determined solely by the following claimsistics of the thickness and material of the core and ring-shaped parts of the bimetallic coin BC can be obtained in detail, which means that the denomination and authenticity of the bimetallic coin BC can be discriminated with high accuracy.

Moreover, the second and third sensors 332 and 334 are arranged in such a way that the central cores 332*aa* and 332*ba* of the second sensor 332 also are opposed to the peripheral part or edge of the bimetallic coin BC when the peripheral edge of the coin BC reaches the central cores 334*aa* and 334*ba* of the third sensor 334. In other words, the distance L7 between the central cores 332*aa* and 332*ba* of the second sensor 332 and the central cores 334*aa* and 334*ba* of the third sensor 334 is defined in such a way that the central cores 332*aa* and 332*ba* and the central cores 334*aa* and 334*ba* are simultaneously opposed to the peripheral edge of the bimetallic coin BC. By such the structure, not only the physical characteristic about the material of the ring-shaped part of the bimetallic coin BC but also the physical characteristic about the diameter of the coin BC can be obtained by the cooperation of the second and third sensors 332 and 334.

Accordingly, by using the physical characteristics about the material and diameter of the bimetallic coin BC obtained by the cooperation of the second and third sensors 332 and 334 for coin discrimination in addition to the physical characteristics about the thickness and material of the ring-shaped and core parts of the coin BC obtained by the first to fourth sensors 330, 332, 334, and 336, the denomination and authenticity of the coin BC can be discriminated more accurately than the case where only the physical characteristics about the material and thickness of the ring-shaped and core parts of the coin BC obtained by the first to fourth sensors 330, 332, 334, and 336 are used.

In the coin discrimination section 104 of the coin discrimination apparatus 100 according to this embodiment, the physical characteristics about the thickness of the coin c are obtained by the first and fourth sensors 330 and 336 and the physical characteristics about the material of the coin C are obtained by the second and third sensors 332 and 334. However, the present invention is not limited to this. The physical characteristics about the material of the coin C may be obtained by the first and fourth sensors 330 and 336 and the physical characteristics about the thickness of the coin C may be obtained by the second and third sensors 332 and 334.

Moreover, similar to the second and third sensors 332 and 334, the physical characteristics about the coin C may be obtained by the cooperation of the first and fourth sensors 330 and 336 by connecting the coils of the first and fourth sensors 330 and 336 in series. Furthermore, the positions and sizes of the central cores 330*aa*, 330*ba*, 332*aa*, 332*ba*, 334*aa*, 334*ba*, 336*aa*, and 336*ba* of the first to fourth sensors 330, 332, 334, and 336, concretely speaking, each of the distances L1, L2, L3, L4, and L7 and the diameters D1, D2, D3, and D4, may be changed appropriately according to the diameter, material, and so on of a target coin C to be discriminated.

The fifth, sixth, and seventh sensors 338, 340, and 342 have the function of acquiring the physical characteristic about the diameter of a coin C in the state where the fifth, sixth, and seventh sensors 338, 340, and 342 are opposed to the opposite peripheral edge (i.e., the remote-side peripheral edge) of a coin C that is carried on the carrying path 320 to the guide 306.

The fifth sensor 338 is located to acquire the physical characteristic of a diameter of a minimum diameter coin SC. Specifically, the pair of central cores 338*aa* and 338*ba* of the fifth sensor 338 is located in such a way as to be opposed to the remote-side peripheral edge of the minimum diameter coin SC. In other words, the distance L5 between the guide-side end of the central cores 338*aa* and 338*ba* of the fifth sensor 338 and the linear part 314 of the guide 306 is set to be smaller than the diameter of the minimum diameter coin SC.

The sixth sensor 340 is located to acquire the physical characteristic of a diameter of a maximum diameter coin LC. Specifically, the pair of central cores 340*aa* and 340*ba* of the sixth sensor 340 is located in such a way as to be opposed to the remote-side peripheral edge of the maximum diameter coin LC. In other words, the distance L6 between the remote-side ends of the central cores 340*aa* and 340*ba* of the sixth sensor 340 and the linear part 314 of the guide 306 is set to be larger than the diameter of the maximum diameter coin LC.

The seventh sensor 342 is placed on the downstream side of the carrying path 320 with respect to the fifth and sixth sensors 338 and 340. Moreover, the central cores 342*aa* and 342*ba* of the seventh sensor 342 are arranged between the central cores 338*aa* and 338*ba* of the fifth sensor 338 and the central cores 340*aa* and 340*ba* of the sixth sensor 340 in the direction which is perpendicular to the extension direction of the linear part 314 of the guide 306 and which is parallel to the surface of the base 302.

By such the structure, the physical characteristic about the diameter of a relatively small diameter coin c can be obtained by the fifth sensor 338, the physical characteristic about the diameter of a relatively large diameter coin C can be obtained by the sixth sensor 340, and the physical characteristic about the diameter of a relatively middle diameter coin C can be obtained by the seventh sensor 342.

The fifth and seventh sensors 338 and 342 are arranged in such a way that the remote-side ends of the central cores 338*aa* and 338*ba* of the fifth sensor 338 and the guide-side ends of the central cores 342*aa* and 342*ba* of the seventh sensor 342 are overlapped with each other by a predetermined length G5 in the direction which is perpendicular to the extension direction of the linear part 314 of the guide 306 and which is parallel to the surface of the base 302. The sixth and seventh sensors 340 and 342 are arranged in such a way that the guide-side ends of the central cores 340*aa* and 340*ba* of the sixth sensor 340 and the remote-side ends of the central cores 342*aa* and 342*ba* of the seventh sensor 342 are overlapped with each other by a predetermined length G6 in the direction which is perpendicular to the extension direction of the linear part 314 of the guide 306 and which is parallel to the surface of the base 302.

By such the structure of the fifth to seventh sensors 338, 340, and 342, the physical characteristic about the diameter of a coin C can be obtained by the fifth to seventh sensors 338, 340, and 342 even in the state where the boundary between the central cores 338*aa* and 338*ba* of the fifth sensor 338 and the central cores 342*aa* and 342*ba* of the seventh sensor 342 and the boundary between the central cores 340*aa* and 340*ba* of the sixth sensor 340 and the central cores 342*aa* and 342*ba* of the seventh sensor 342 are opposed to the peripheral edge of the coin C.

The fifth to seventh sensors 338, 340, and 342 are arranged in such a way that the physical characteristic about the diameter of a relatively small diameter coin C can be obtained by the fifth sensor 338, the physical characteristic about the diameter of a relatively large diameter coin C can be obtained by the sixth sensor 340, and the physical characteristic about the diameter of a relatively middle diameter coin C can be obtained by the seventh sensor 342 within the target coins c to be discriminated. This means that the physical characteristic about the diameter of a coin C is obtained by one of the fifth to seventh sensors 338, 340, and 342 according to the diameter value of a coin C. Accordingly, compared with the case where the physical characteristic about the diameter of a coin is obtained by a single coin detection sensor, the physical characteristic about the diameter of a coin C can be obtained in more detail, which means that the denomination and authenticity of a coin c can be discriminated with higher accuracy by using the physical characteristic about the diameter of the coin C obtained by the second and third sensors 332 and 334 along with the physical characteristics about the diameter of the coin C obtained respectively by the fifth to seventh sensors 338, 340, and 342.

In addition, the arrangements or layouts of the first to seventh coin detection sensors 330, 332, 334, 336, 338, 340, and 342 may be changed appropriately according to the length of the carrying path 320, the diameter of target coins to be discriminated and so on. For example, the fifth to seventh sensors 338, 340, and 342 may be arranged on the downstream side of the carrying path 320 with respect to the first to fourth sensors 330, 332 334, and 336. The second and third sensors 332 and 334 may be arranged on the downstream side of the carrying path 320 with respect to the first to fourth sensors 330, 332 334, and 336.

[Driving Mechanism]

Next, the driving mechanism 106 of the coin discrimination apparatus 100 will be explained below with reference to FIG. 9.

The driving mechanism 106 has the function of driving or rotating the rotary disk 202 of the coin separating and forwarding section 102 and the rotator 304 of the coin discrimination section 104. The driving mechanism 106 comprises a driving gear 242 that receives driving power from a driving source 240, a first driven gear 244 that rotates the disk 202, and a second driven gear 350 that rotates the rotator 304.

The driving gear 242 is connected to the output shaft of a motor (not shown) as the driving source 240. The first driven gear 244, which is in the form of a spur gear, is integrally configured with the disk 202 on the rear side of the disk 202. Therefore, the disk 202 is rotated along with the rotation of the first driven gear 244. Moreover, the second driven gear 350, which is in the form of a spur gear, is placed on the rear side of the base 302. The second driven gear 350 is configured to be rotatable around the rotation axis 318, and is fixed to the rotator 304 with a rotational shaft 352 penetrating through the base 302 along the rotation axis 318. Therefore, the rotator 304 is rotated along with the rotation of the second driven gear 350.

In the driving mechanism 106, the first driven gear 244 is drivingly connected to the driving gear 242, and the second driven gear 350 is drivingly connected to the first driven gear 244. For this reason, if the driving gear 242 is rotated in the second rotation direction R2, the first driven gear 244 is rotated in the first rotation direction R1. If the first driven gear 244 is rotated in the first rotation direction R1, the second driven gear 350 is rotated in the second rotation direction R2. Accordingly, the first driven gear 244 and the disk 202 are rotated in the first direction R1 along with the rotation of the driving gear 242 in the second direction R2 and then, the second driven gear 350 and the rotator 304 are rotated in the second direction R2.

The gear ratio of the first and second driven gears 244 and 350 is fixed at 1 1. The rotation of the disk 202 and the rotation of the rotator 304 are synchronized in such a way that coins C are rotated by the pushing members 316*a*, 316*b*, and 316*c* of the rotator 304 immediately after the coins C which have been sent out from each of the coin receiving parts 206*a*, 206*b*, and 206*c* are received by the receiver 204.

The gear ratio of the first and second driven gears 244 and 350 is not limited to 1 1 and may be changed appropriately according to the ratio between the count of the coin receiving parts 206 of the disk 202 and the count of the pushing members 316 of the rotator 304.

[Advantageous Effects of Coin Discrimination Apparatus]

With the coin discrimination apparatus 100 according to the embodiment of the present invention, as explained above in detail, the base 302 having the carrying path 320, the rotator 304 for carrying coins C on the carrying path 320 one by one, the guide 306 for guiding the coins C along the carrying path 320, and the coin detector 308 for detecting physical characteristics of the coins C are provided. The coins C that are moved on the carrying path 320 are carried to a predetermined position through the coin detector 308 itself or through the vicinity of the coin detector 308. The coins C that are carried on the carrying path 320 due to the rotation of the rotator 304 are guided by contacting the peripheral face pf the coin C with the guide 306.

The coin detector 308 comprises the first to fourth coin detection sensors 330, 332, 334, and 336, which are located at different positions with respect to the guide 306. This means that the positions of the first to fourth coin detection sensors 330, 332, 334, and 336 are respectively determined using the guide 306 as a reference. Moreover, the coin C that is moved on the carrying path 320 is guided by contacting the peripheral face of the coin c with the guide 306 that extends along the carrying path 320.

Therefore, the positional relationships between each of the coins C that are carried on the carrying path 320 with the first to fourth coin detection sensors 330, 332, 334, and 336 are kept approximately the same for all the coins C thus carried. Accordingly, the physical characteristics about the peripheral and core parts of the coin C that is moved on the carrying path 320 can be detected accurately with the first to fourth coin detection sensors 330, 332, 334, and 336.

Furthermore, the additional physical characteristic about the peripheral part of the coin C that is moved on the carrying path 320 is obtained by cooperation of the second and third coin detection sensors 332 and 334 when the coin C that is moved on the carrying path 320 reaches the third coin detection sensor 334. This means that the physical characteristics about the different positions of the peripheral part of the coin C can be detected by the second and third coin detection sensors 332 and 334 approximately simultaneously. For this reason, coin discrimination can be performed using not only the physical characteristics obtained by the first to fourth coin detection sensors 330, 332, 334, and 336 but also the additional physical characteristic obtained by the cooperation of the second and third coin detection sensors 332 and 334.

Accordingly, the denomination and authenticity of the coins C can be discriminated more accurately compared with the case where the additional physical characteristic is not obtained by the cooperation of the second and third coin detection sensors 332 and 334.

In the case of discriminating a bimetallic coin BC comprising a ring-shaped part (i.e., a peripheral part) and a core part (i.e., a central part) which are made of different materials or different-composition materials (e.g., different metals and/or alloys), the physical characteristics about the peripheral part of the bimetallic coin BC are respectively obtained by the first and third coin detection sensors 330 and 334 at different positions, and the physical characteristics about the central part of the bimetallic coin BC are respectively obtained by the second and fourth coin detection sensors 332 and 336 at different positions. Moreover, the additional physical characteristic about the peripheral part of the bimetallic coin BC is obtained by cooperation of the second and third coin detection sensors 332 and 334.

Therefore, even if the connecting portion of the bimetallic coin BC, which connects the ring-shaped part (peripheral part) and the core part (central part), includes some structural unevenness, the physical characteristics obtained by the first to fourth coin detection sensors 330, 332, 334, and 336 and the additional physical characteristic obtained by cooperation of the second and third coin detection sensors 332 and 334 are unlikely to be affected by the structural unevenness of the connecting portion.

Accordingly, the denomination and authenticity of coins C can be discriminated with high accuracy even if they are bimetallic coins BC.

Furthermore, in the aforementioned coin discrimination apparatus 100 according to this embodiment, the coin detector 308 further comprises the fifth, sixth, and seventh coin detection sensors 338, 340, and 342. The fifth coin detection sensor 338 is located at a further position from the guide 306 than the second and fourth coin detection sensors 332 and 336. The sixth coin detection sensor 340 is located at a further position from the guide 306 than the fifth coin detection sensor 338. The seventh coin detection sensor 342 is located on the downstream side of the carrying path 320 with respect to the fifth and sixth coin detection sensors 338 and 340. Each of the fifth to seventh coin detection sensors 338, 340, and 342 has the function of obtaining the physical characteristic about the diameter of the coin C that is moved on the carrying path 320.

Accordingly, the physical characteristic about the diameter of the coin c having a relatively small diameter is obtained by the fifth coin detection sensor 338, the physical characteristic about the diameter of the coin c having a relatively large diameter is obtained by the sixth coin detection sensor 340, and the physical characteristic about the diameter of the coin having a relatively middle diameter is obtained by the seventh coin detection sensor 342. Thus, compared with the case where the physical characteristic about the diameter of the coin C is obtained by a single coin detection sensor, the physical characteristics about the diameter of the coin C can be obtained in more detail.

As a result, there is an additional advantage that the denomination and authenticity of the coin can be discriminated with higher accuracy than the case where the coin detector 308 does not comprise the fifth, sixth, and seventh coin detection sensors 338, 340, and 342.

Variations

It is needless to say that the present invention is not limited to the above-described embodiment and its variations. Any other modification is applicable to the embodiment and variations.

For example, in the aforementioned coin discrimination apparatus 100 according to the embodiment of the present invention, the structure of the coin separating and forwarding section 102 is not limited to the one explained in this embodiment. For example, the coin separating and forwarding apparatus disclosed in the Japanese Non-Examined Patent Publication No. 2014-041396 may be used for the coin separating and forwarding section 102. The coin separating and forwarding apparatus of the Publication No. 2014-041396 comprises a moving member that is reciprocated linearly along the diameter direction of a rotary disk in conjunction with the rotation of the disk. Coins C are separated from each other by the moving member and then, forwarded to the next process.

The structural elements and their shapes and sizes are preferred examples of the present invention; it is needless to say that any other structural elements may be used and these shapes and sized may be changed according to the necessity.

The present invention is applicable to any type of coin processing apparatuses for processing coins. For example, the present invention may be preferably applied to change machines, money changers, vending machines, automated teller machines, ticket-vending machines and so on.

While the preferred forms of the present invention have been described, it is to be understood that modifications will be apparent to those skilled in the art without departing from the spirit of the invention. The scope of the present invention, therefore, is to be determined solely by the following claims

What is claimed is:

1. A coin discrimination apparatus comprising:

a base having a carrying path on which coins are carried, wherein one surface of each coin that is moved on the carrying path is supported by the base;

a rotator configured to be rotatable around a rotation axis perpendicular to the base, wherein the rotator has pushing members by which coins are carried on the carrying path one by one due to rotation of the rotator;

a guide formed outside a rotation area of the rotator so as to extend along the carrying path, wherein a coin that is moved on the carrying path is guided by contacting a peripheral face of the coin with the guide having an upwardly inclined linear contact surface wherein the coin is pushed by the rotator pushing members along the linear contact surface; and a coin detector for detecting physical characteristics of a coin that is moved on the carrying path, wherein the coin detector is located along the carrying path;

wherein the coin detector comprises a first coin detection sensor, a second coin detection sensor, a third coin detection sensor, and a fourth coin detection sensor;

the first coin detection sensor, which is located near the guide, has a function of obtaining a physical characteristic about a peripheral part of a coin that is moved on the carrying path; the second coin detection sensor, which is located apart from the guide at a predetermined interval, has a function of obtaining a physical characteristic about a central part of the coin that is moved on the carrying path;

the third coin detection sensor, which is located on a downstream side of the carrying path at a predetermined interval with respect to the first coin detection sensor and which is located near the guide, has a function of obtaining a physical characteristic about the peripheral part of the coin that is moved on the carrying path;

the fourth coin detection sensor, which is located on the downstream side of the carrying path at a predetermined interval with respect to the second coin detection sensor and which is located apart from the guide at a predetermined interval, has a function of obtaining a physical characteristic about the central part of the coin that is moved on the carrying path; and an additional physical characteristic about the peripheral part of the coin that is moved on the carrying path is obtained by cooperation of the second coin detection sensor and the third coin detection sensor when the coin that is moved on the carrying path reaches the third coin detection sensor, wherein the physical characteristic about the peripheral part of the coin obtained by the first coin detection sensor is a physical characteristic about a thickness of the peripheral part of the coin;

the physical characteristic about the central part of the coin obtained by the second coin detection sensor is a physical characteristic about a material of the central part of the coin;

the physical characteristic about the peripheral part of the coin obtained by the third coin detection sensor is a physical characteristic about a material of the peripheral part of the coin;

the physical characteristic about the central part of the coin obtained by the fourth coin detection sensor is a physical characteristic about a thickness of the central part of the coin; and the additional physical characteristic about the peripheral part of the coin obtained by cooperation of the second and third coin detection sensors is a physical characteristic about the material and a diameter of the peripheral part of the coin, wherein the coin detector further comprises fifth, sixth, and seventh coin detection sensors;

the fifth coin detection sensor is located at a further position from the guide than the second and fourth coin detection sensors;

the sixth coin detection sensor is located at a further position from the guide than the fifth coin detection sensor;

the seventh coin detection sensor is located on the downstream side of the carrying path with respect to the fifth and sixth coin detection sensors; and each of the fifth to seventh coin detection sensors has a function of obtaining a physical characteristic about a diameter of the coin that is moved on the carrying path.

2. The coin discrimination apparatus according to claim 1 wherein each of the first to fourth coin detection sensors comprises a pair of magnetic material cores and coils wound respectively around the cores.

3. The coin discrimination apparatus according to claim 1, wherein the physical characteristic about a diameter of a coin having a relatively small diameter is obtained by the fifth coin detection sensor;

the physical characteristic about a diameter of a coin having a relatively large diameter is obtained by the sixth coin detection sensor; and the physical characteristic about a diameter of a coin having a relatively middle diameter is obtained by the seventh coin detection sensor.

4. The coin discrimination apparatus of claim 1, wherein the second coin detection sensor has a central core positioned above the guide rail where the distance L2 between the guide rail and central core is larger than the width W2 of a ring-shaped part of a bimetallic coin BC and smaller than the sum of the diameter W1 of the core part of the bimetallic coin and the width W2 of the ring-shaped part of the bimetallic coin BC wherein $$W1<L2<W1+W2.$$

* * * * *